US008087990B2

(12) United States Patent
Lind et al.

(10) Patent No.: US 8,087,990 B2
(45) Date of Patent: Jan. 3, 2012

(54) METHOD AND SYSTEM FOR CONDUCTING MULTIPLE CONCURRENT BINGO GAMES

(75) Inventors: Clifton E. Lind, Austin, TX (US); Brendan M. O'Connor, Austin, TX (US); Gary L. Loebig, Austin, TX (US); Rodney L. Willard, Flower Mound, TX (US); Naveen Malhotra, Murphy, TX (US); Martin A. Keane, Chicago, IL (US); Joseph R. Enzminger, Austin, TX (US); Jefferson C. Lind, Austin, TX (US); Gordon T. Graves, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 1053 days.

(21) Appl. No.: 11/875,697

(22) Filed: Oct. 19, 2007

(65) Prior Publication Data

US 2008/0045301 A1 Feb. 21, 2008

Related U.S. Application Data

(63) Continuation of application No. 10/456,721, filed on Jun. 6, 2003, now abandoned.

(60) Provisional application No. 60/444,503, filed on Feb. 3, 2003.

(51) Int. Cl.
*A63F 9/24* (2006.01)

(52) U.S. Cl. ..... 463/19

(58) Field of Classification Search ..... 463/19
See application file for complete search history.

(56) References Cited

U.S. PATENT DOCUMENTS

| | | | |
|---|---|---|---|
| 4,455,025 | A | 6/1984 | Itkis |
| 5,393,057 | A | 2/1995 | Marnell, II |
| 5,639,088 | A | 6/1997 | Schneider et al. |
| 5,857,911 | A | 1/1999 | Fioretti |
| 5,935,002 | A | 8/1999 | Falciglia |
| 6,012,984 | A | 1/2000 | Roseman |
| 6,159,095 | A | 12/2000 | Frohm et al. |
| 6,186,892 | B1 | 2/2001 | Frank et al. |
| 6,203,433 | B1 | 3/2001 | Kume |
| 6,280,325 | B1 | 8/2001 | Fisk |
| 6,398,645 | B1 | 6/2002 | Yoseloff |
| 6,428,413 | B1 | 8/2002 | Carlson |
| 6,530,840 | B1 | 3/2003 | Cuomo et al. |
| 6,537,150 | B1 | 3/2003 | Luciano et al. |
| 6,569,017 | B2 | 5/2003 | Enzminger et al. |
| 6,581,935 | B1 | 6/2003 | Odom |

(Continued)

OTHER PUBLICATIONS

EverGreen and Tooty Frooty Bingo. Same Game, Two Names. Brochure, Dec. 1998, 2 pages.

*Primary Examiner* — Corbett B Coburn
(74) *Attorney, Agent, or Firm* — Russell D. Culbertson; The Culbertson Group, P.C.

(57) ABSTRACT

A method for conducting bingo games includes using a server to collect game play requests from a plurality of electronic player stations. The server determines if a group of the collected game play requests meets one or more predefined conditions for establishing a quorum, and if so conducts a game with the group of game play requests. Even after the game is started, the server continues to collect game play requests in preparation for conducting additional games. When enough game play requests are collected, the server starts the next game, even if previous games are still in progress.

19 Claims, 12 Drawing Sheets

U.S. PATENT DOCUMENTS

| | | | |
|---|---|---|---|
| 6,585,590 | B2 | 7/2003 | Malone |
| 6,604,997 | B2 | 8/2003 | Saidakovsky et al. |
| 6,656,040 | B1 | 12/2003 | Brosnan et al. |
| 6,729,959 | B1 | 5/2004 | Moore et al. |
| 6,743,102 | B1 | 6/2004 | Fiechter et al. |
| 6,780,108 | B1 | 8/2004 | Luciano, Jr. et al. |
| 6,860,810 | B2 | 3/2005 | Cannon et al. |
| 7,059,966 | B2 | 6/2006 | Luciano, Jr. et al. |
| 2001/0031660 | A1 | 10/2001 | Wilk et al. |
| 2002/0094859 | A1 | 7/2002 | Hirsch et al. |
| 2002/0094860 | A1 | 7/2002 | Itkis et al. |
| 2002/0132661 | A1 | 9/2002 | Lind et al. |
| 2002/0132666 | A1 | 9/2002 | Lind et al. |
| 2002/0177478 | A1 | 11/2002 | Glasson et al. |
| 2003/0045345 | A1 | 3/2003 | Berman |
| 2003/0064772 | A1 | 4/2003 | Tempest et al. |
| 2004/0009811 | A1 | 1/2004 | Torango |
| 2004/0048647 | A1 | 3/2004 | Lind et al. |
| 2004/0152510 | A1 | 8/2004 | Herrmann et al. |

Card Definition File 1101

1104

| | Header Information |
|---|---|
| 1102 0 | spot1, spot2, spot3, etc |
| 1102 1 | spot1, spot2, spot3, etc |
| 1102 2 | etc |
| 1102 3 | etc |
| | • • • • • |
| x | spot1, spot2, spot3, etc |

*FIG. 11*

1201

| | | |
|---|---|---|
| 1 8 | 2 15 | 3 1 |
| 4 7 | 5 2 | 6 18 |
| 7 5 | 8 11 | 9 24 |

*FIG. 12*

METHOD AND SYSTEM FOR CONDUCTING MULTIPLE CONCURRENT BINGO GAMES

CROSS-REFERENCE TO RELATED APPLICATIONS

This application is a continuation of U.S. patent application Ser. No. 10/456,721, filed Jun. 6, 2003 now abandoned, and entitled "Method, System, and Program Product for Conducting Multiple Concurrent Bingo Games." The benefit of this prior application is hereby claimed in the present application pursuant under 35 U.S.C. §120. This application also claims the benefit under 35 U.S.C. §119(e) of U.S. Provisional Patent Application Ser. No. 60/444,503 filed, Feb. 3, 2003, and entitled, "Rapid Play Electronic Bingo Gaming System." The entire content of each of these prior applications is incorporated herein by this reference.

TECHNICAL FIELD OF THE INVENTION

This invention relates to electronic gaming systems enabling players from many different gaming locations to participate in bingo games. More particularly, the invention is directed to apparatus, methods, and program products for aiding players in the rapid and secure play of bingo games and for enhancing player participation in bingo games.

BACKGROUND OF THE INVENTION

The game referred to generally as "Bingo" is played with predetermined bingo cards that include a number of designations randomly arranged in a grid or other layout of spots or locations. The bingo cards may be physically printed on paper or another suitable material, or may be represented by a data structure which defines the various card locations and designations associated with the locations. In the traditional bingo game sequence, a number of the predetermined bingo cards are put in play for a particular game. After the sale of bingo cards is closed for a given game, designations are randomly selected from a pool of available designations and matched to the designations on each bingo card that is in play in the game. This matching of bingo designations randomly selected for a game and bingo designations associated with a card in play in the game is commonly referred to as daubing the card and results in a pattern or arrangement of matched spots or card locations. Daubing was done manually by the player holding the bingo card in traditional bingo games, and then by a game administrator to verify a win in the game. More recent bingo gaming systems automatically check for winning patterns on a bingo card as designations are randomly selected for a game. Regardless of how the bingo cards in play in a game are daubed, the first card which is daubed in some predefined way is considered a winning card for the game. The predefined way in which a card must be matched or daubed to produce a win in the game is commonly defined in terms of some identifiable pattern of matched or daubed locations on the card.

Although traditional bingo games remain popular, traditional paper bingo games are played relatively slowly. The card purchasing or buy-in period, the sequential ball draw and announcement of each individual designation, and then winner verification together consume a good deal of time. The time required to play a traditional bingo game limits the player excitement with the game and thus limits player satisfaction.

Various systems have been developed to aid players in playing bingo games and to enhance player participation in the games. The MegaMania™ gaming system offered by Multimedia Games, Inc. comprises a bingo gaming system in which players at different gaming facilities over a large geographic area may participate in bingo games. The players participate in bingo games in the MegaMania™ system through electronic player stations that are maintained at various gaming facilities across the United States. Electronic bingo game systems and electronic player stations may increase the speed at which certain operations in a bingo game may be performed. However, even in electronically implemented bingo games, there has invariably been a delay in determining game results and displaying those results to the various participants in the game.

SUMMARY OF THE INVENTION

The present invention provides apparatus, methods, and program products for conducting bingo games. A method according to the present invention includes using a server to collect game play requests from a plurality of electronic player stations (the electronic player stations also referred to herein simply as "player stations"). The server determines if a group of the collected game play requests meets one or more predefined conditions for establishing a quorum, and if so, conducts a game with the group of game play requests. Even after the game is in play, the server continues to collect game play requests for subsequent or additional games. When enough game play requests are collected, the server starts the next game, even if one or more previous games are still in progress.

The server may determine if the conditions for a quorum are met in a number of different ways. One way is for the server to compare the number of game play requests collected into a group to a predetermined minimum number N of game play requests required to establish a quorum. For example, if 20 players are required to establish a quorum (that is, N=20), then the server may use a counter to count each game play request as the request is collected. Once 20 game play requests have been collected, the server conducts a game with the group of 20 game play requests. Alternatively, the server can count the number of game play requests periodically after a desired period of time. If 20 game play requests have been collected by the end of a given time increment, then the server begins a game.

In other forms of the invention, game play requests are collected in a data storage structure such as a queue and the server monitors a particular queue element or location (that is, a particular storage location in the queue) to determine if a game play request or data associated with such a request has been stored at that queue location. If a game play request has been stored in the monitored queue location, the condition for establishing a quorum has been met. For example, if the server monitors the fifteenth queue location, whenever 15 game play requests have been collected by the server, the fifteenth queue location will be allocated to valid data. The server may check the status of the queue location immediately after each game play request is received, or periodically at some time increment.

A system according to the invention typically includes a large number of electronic player stations and one or more servers connected to the electronic player stations over a communications network. Each electronic player station is used to generate a game play request in response to a player input at the player station. Each game play request entered at a player station is communicated to the server over an appropriate communications arrangement. The server uses the game play requests to conduct multiple bingo games at the same time. Each game play request is ultimately associated with a bingo card either at the electronic player station or by the server or perhaps some other element in the present system.

The invention may be implemented through a program product stored on a computer readable medium and adapted to be executed by one or more processing devices. In a particular embodiment, the program product includes first collection program code, quorum checking program code, game program code, and second collection program code. The first collection program code is responsible for collecting game play requests from electronic player stations. Each game play request is associated with a bingo card representation using appropriate linking program code. Once the game program code detects that a quorum of game play requests have been collected, it conducts a bingo game with the bingo card representations associated with the game play requests collected by the first collection code. However, even while the game program code conducts a bingo game with the first group of game play requests, the second collection program code causes the system to continue collecting game play requests from electronic player stations to produce a new group of requests to be included in another bingo game.

The first quorum checking program code is preferably executed by the server, and is used to determine if a first group of game play requests meets a predefined condition for a first quorum, that is, for conducting a game with the game play requests in that group. This program code may include comparison code for comparing the number of collected game play requests in the group to a minimum number N of game play requests required for a quorum. The comparison code may in turn include counter program code for counting the number of game play requests collected for each particular group. Alternatively to comparison code, embodiments of the invention may include allocation program code for determining if a particular queue location in a grouping queue has been allocated, thus indicating that a certain number of game play requests have been collected for a group. Timer program code may be included in a program product according to the invention for checking for a quorum periodically according to some schedule. Alternatively to timer program code for periodically checking for a quorum, the invention may include receipt-check program code for checking for a quorum in response to each game play request collected in a group.

These and other advantages and features of the invention will be apparent from the following description of the preferred embodiments, considered along with the accompanying drawings.

BRIEF DESCRIPTION OF THE DRAWINGS

FIG. 11 is a diagrammatic representation of a bingo card definition file that may be used in a bingo gaming system according to the present invention.

FIG. 12 is a diagrammatic representation of a bingo card face that may be employed in bingo games played in the present invention.

DESCRIPTION OF PREFERRED EMBODIMENTS

Figure 1:
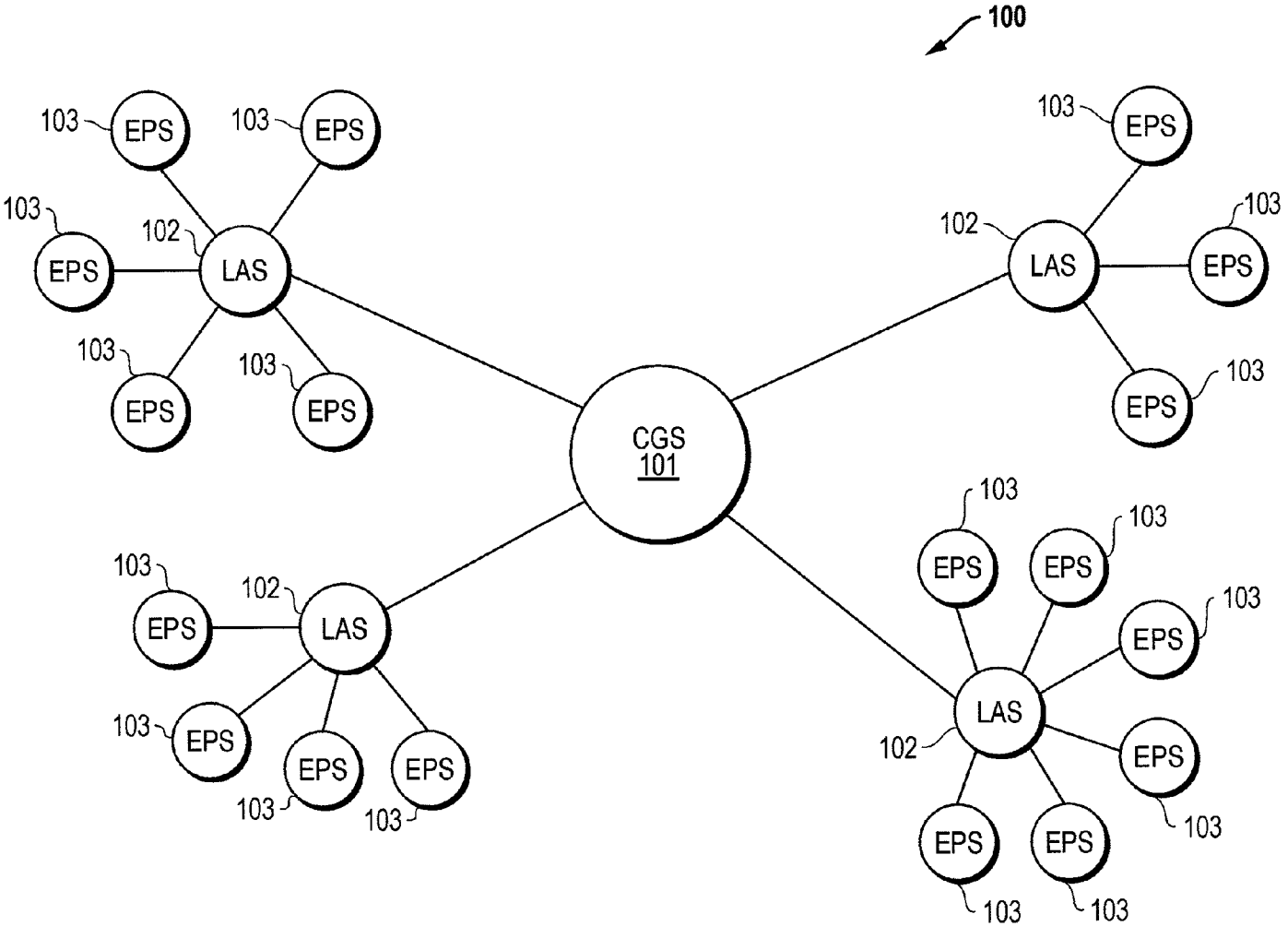
FIG. 1 is a high level diagrammatic representation of a bingo gaming system embodying the principles of the present invention.

FIG. 1 shows a gaming system 100 including a central game server (CGS) 101 that cooperates with a number of other components to enable bingo players, preferably at many different remote gaming sites, to participate in bingo games. Each gaming site includes a local area server (LAS) 102 and a number of electronic player stations (EPSs) 103. As will be discussed in detail below, in the normal operation of gaming system 100, a player at any EPS 103 in the system may participate in a given bingo game with players at any other EPSs 103 in the system. Thus, players at different gaming facilities may be grouped together for a given bingo game administered through system 100. Grouping together players from different gaming facilities for the play of a bingo game allows different bingo games to be played rapidly and minimizes the time that players must wait to receive the result of their participation in the bingo game.

The invention includes an arrangement for grouping players and/or game play requests for the play of a single bingo game to facilitate rapid play. This grouping includes limiting the number of players and/or game play requests included in a bingo game to reduce the time required to play the game. System 100 reduces the time between a game play request at one of the EPSs 103 and the return of results to the respective EPS sufficiently to allow a great deal of flexibility in how results in the bingo game are displayed to the player. In particular, the bingo game results may be displayed in some manner unrelated to bingo. For example, the bingo game results may be mapped to a display traditionally associated with a reel-type game (slot machine), to a display relating to a card game, or to a display showing a race such as a horse or dog race, for example. Preferred techniques for mapping bingo game results to displays associated with games or contests unrelated to bingo are described in U.S. patent application Ser. No. 10/060,643 filed Jan. 30, 2002, and entitled "Method, Apparatus, and Program Product for Presenting Results in a Bingo-Type Game." The entire content of this prior application is hereby incorporated herein by this reference.

System 100 rapidly groups players and/or game play requests and starts one game after another so that multiple games may be in play at any given time. That is, once a first group of players or game play requests has been assigned to a bingo game offered through system 100, the system proceeds to simultaneously administer a bingo game for the first group of players or game play requests and also begin grouping players or game play requests for a next bingo game. System 100 does not necessarily wait for one bingo game to be completed before starting to collect players or game play requests for, and actually beginning play in, the next bingo game. The number of players or game play requests grouped for the play of bingo games according to the present invention may be limited to reduce the time required for grouping. For example, each bingo game offered through gaming system 100 shown in FIG. 1 may be limited to between 2 to 20 players or game play requests, with the preferred number for any given game being from 10 to 15. Where system 100 includes numerous EPSs 103 at the various remote locations, on the order of several thousand EPSs for example, hundreds of individual bingo games may be in process at any given time through the gaming system.

Regardless of the rapid play facilitated by system 100 and regardless of the manner in which the bingo game results are displayed, the underlying game remains a standard bingo game played in the traditional sequence of play for bingo games. That is, each player obtains or is assigned a bingo card or bingo card representation, all bingo cards in play in the game are daubed or checked for matches with a randomly generated sequence of designations (for example, designations produced in a ball draw or produced by a random number generator), and the first card in the game to match the sequence of designations to produce the game ending winning pattern wins the bingo game. Additional prizes may be awarded for other patterns that may be produced in the course of the bingo game. The mapping of different prizes to various bingo patterns that may be produced in the course of a bingo game in system 100 may be accomplished as described in U.S. Pat. No. 6,569,017 B2, entitled "Method for Assigning Prizes in Bingo-Type Games" or U.S. patent application Ser. No. 10/238,313, filed Sep. 10, 2002, entitled "Prize Assignment Method and Program Product for Bingo-Type Games." The entire content of each of these documents is incorporated herein by this reference.

Figure 2:
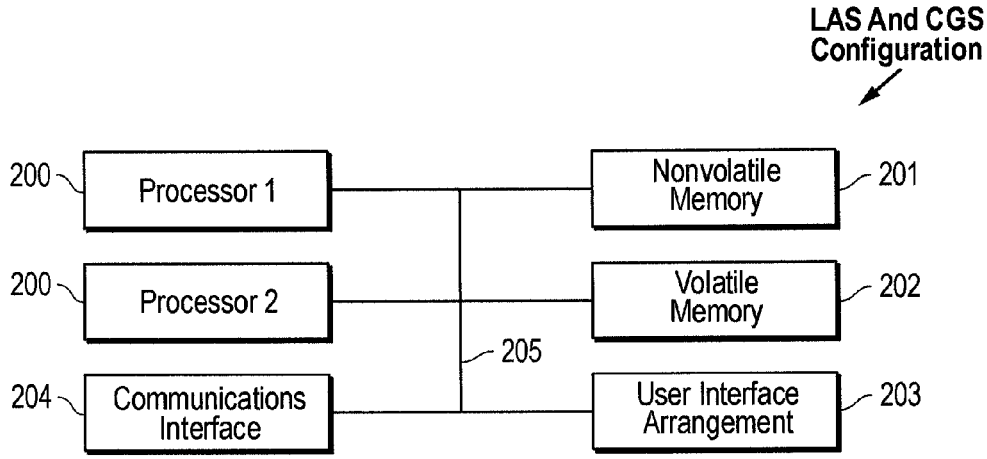
FIG. 2 is a diagrammatic representation of a computer system arrangement that may be used for the central game server and local area servers included in the system shown in FIG. 1.

CGS 101 may comprise a computer system such as the basic system shown in FIG. 2. The basic system may include one or more processors 200, nonvolatile memory 201, volatile memory 202, a user interface arrangement 203, and a communications interface 204, all connected to a system bus 205. It will be appreciated that user interface arrangement 203 may include a number of different devices such as a keyboard, a display, and a pointing device such as a mouse or trackball for example, although not shown in FIG. 2. Alternatively to the integrated user interface arrangement 203 shown in FIG. 2, a user interface for CGS 101 may be provided through a separate computer (not shown) in communication with the CGS. Regardless of the particular configuration for CGS 101, in the normal operation of system 100 shown in FIG. 1, the CGS functions to group players for participation in bingo games offered through the system, produces or obtains sequences of designations (ball draws, for example) for the play of the bingo games, checks for the results in the bingo games, and communicates the results to LASs 102. Specific processes performed by CGS 101 to provide these functions will be described below with reference to FIGS. 6 and 8.

As used in this disclosure any sequence of designations that may be matched against bingo cards or card representations in the present gaming system will be referred to as a "ball draw" regardless of how the sequence is actually generated. Under this definition, it will be appreciated that a ball draw may be produced by a random number generator, a pseudo random number generator, or any other suitable device or system, and not necessarily a physical ball draw device.

Each LAS 102 included in system 100 as shown in FIG. 1 may comprise a computer system having the same basic structure as shown in FIG. 2. That is, each LAS 102 may include one or more processors 200, nonvolatile memory 201, volatile memory 202, user interface arrangement 203, and communications interface 204, all connected to system bus 205. As with CGS 101, the user interface for the respective LAS 102 may be provided through a separate computer in communication with the LAS rather than the integrated user interface arrangement 203 shown in FIG. 2. Regardless of the specific configuration of the LAS, each LAS serves, in normal operation of the system shown in FIG. 1, to transfer or relay information from its respective EPSs 103 to CGS 101 and transfer or relay information from the CGS to the LAS's respective EPSs. Each LAS according to the present invention may also have the ability to group players and actually play bingo games in certain situations. For example, where one LAS 102 serves a large number of EPSs 103, the LAS may group players or game play requests from its respective EPSs during a time of high player activity, obtain or produce a ball draw, identify results, and return results to the EPSs rather than having the CGS 101 perform these tasks. Also, each LAS 102 shown in FIG. 1 may be configured to perform the tasks normally performed by CGS 101 in the event the communications link between the respective LAS and CGS is degraded below a certain level or is severed altogether. Specific processes that may be performed by LASs 102 according to the invention will be described below with reference to FIGS. 5 and 7.

Figure 3:
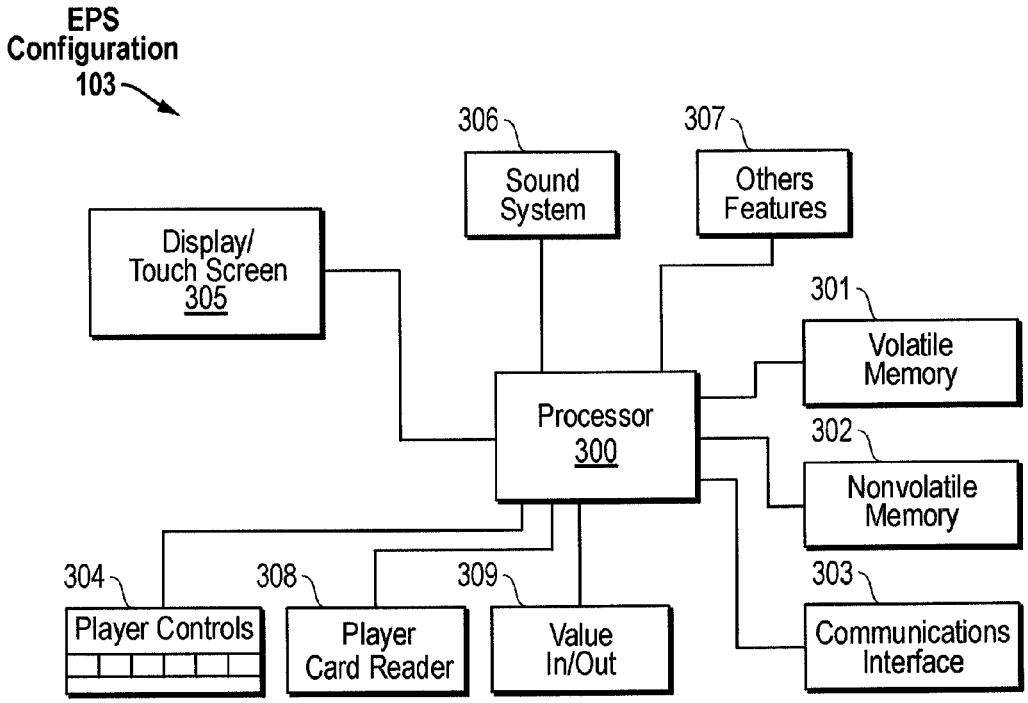
FIG. 3 is a diagrammatic representation of an electronic player station that may be used in the system shown in FIG. 1.

FIG. 3 shows an example of an EPS 103 that may be used in a gaming system embodying the principles of the present invention. The illustrated EPS 103 includes a processor 300, volatile memory 301, nonvolatile memory 302, and a communications interface 303. The volatile and nonvolatile memory stores computer program code that may be executed by processor 300 to cause the processor to perform or direct the various functions provided by EPS 103. Communications interface 303 allows communications between EPS 103 and its respective LAS 102 and/or CGS 101. EPS 103 also includes a special user interface arrangement to facilitate player participation in the bingo games offered through gaming system 100 shown in FIG. 1, and display results in an exciting and attractive format. This interface includes player controls 304, a display or touch screen display 305, a sound system 306, and perhaps other features 307 such as alarms or special displays or alerting devices. Each EPS 103 also preferably includes a convenient system for allowing the player to input player-specific information and for receiving wagers and dispensing winnings. For example, the EPS 103 shown in FIG. 3 includes a player card reader 308 that is adapted to read player-specific information from a player account card inserted into the reader. A player account card may, for example, include player information or simply a player identifier encoded on a magnetic medium (mag stripe) associated with the card, or encoded on bar code, or a memory device associated with the player card. The illustrated EPS 103 also includes a device 309 for receiving value and issuing value in the course of play. This device may accept currency, vouchers, or tokens, for example, and also output currency, vouchers, or tokens. Of course a separate device may be used to receive and issue value for games played according to the present invention. Alternatively or in addition to value in/out device 309, EPSs 103 may read player account information from the player card or player information otherwise input at the EPS, and account for wagers and winnings in the manner set out in U.S. patent application Ser. No. 10/044,478, filed Jan. 10, 2002, entitled "Distributed Account Based Gaming System," the entire content of which is hereby incorporated herein by this reference.

It will be appreciated that the particular configuration of devices shown in FIG. 1 is shown only for purposes of example. A bingo gaming system according to the present invention may omit some or all of the separate LASs 102 at the various gaming facilities so that the EPSs 103 communicate directly with CGS 101. Also, various regions or different gaming facilities may be divided up into separate systems each having a respective CGS such as CGS 101. In these situations the system could be configured such that a single EPS 103 may be serviced by any of the CGSs. Furthermore, a gaming system embodying the principles of the invention may include multiple CGSs rather than a single CGS 101 as shown in FIG. 1.

In the following description of FIG. 4 and the other process flow charts in this disclosure, it will be appreciated that the references to the physical components are references to the diagrams in FIGS. 1, 2, and 3 that show those components. The components, such as EPSs 103, LASs 102, and CGS 101 discussed with reference to the flow charts are generally not shown in the flow charts themselves but are shown particularly in FIG. 1.

Figure 4:
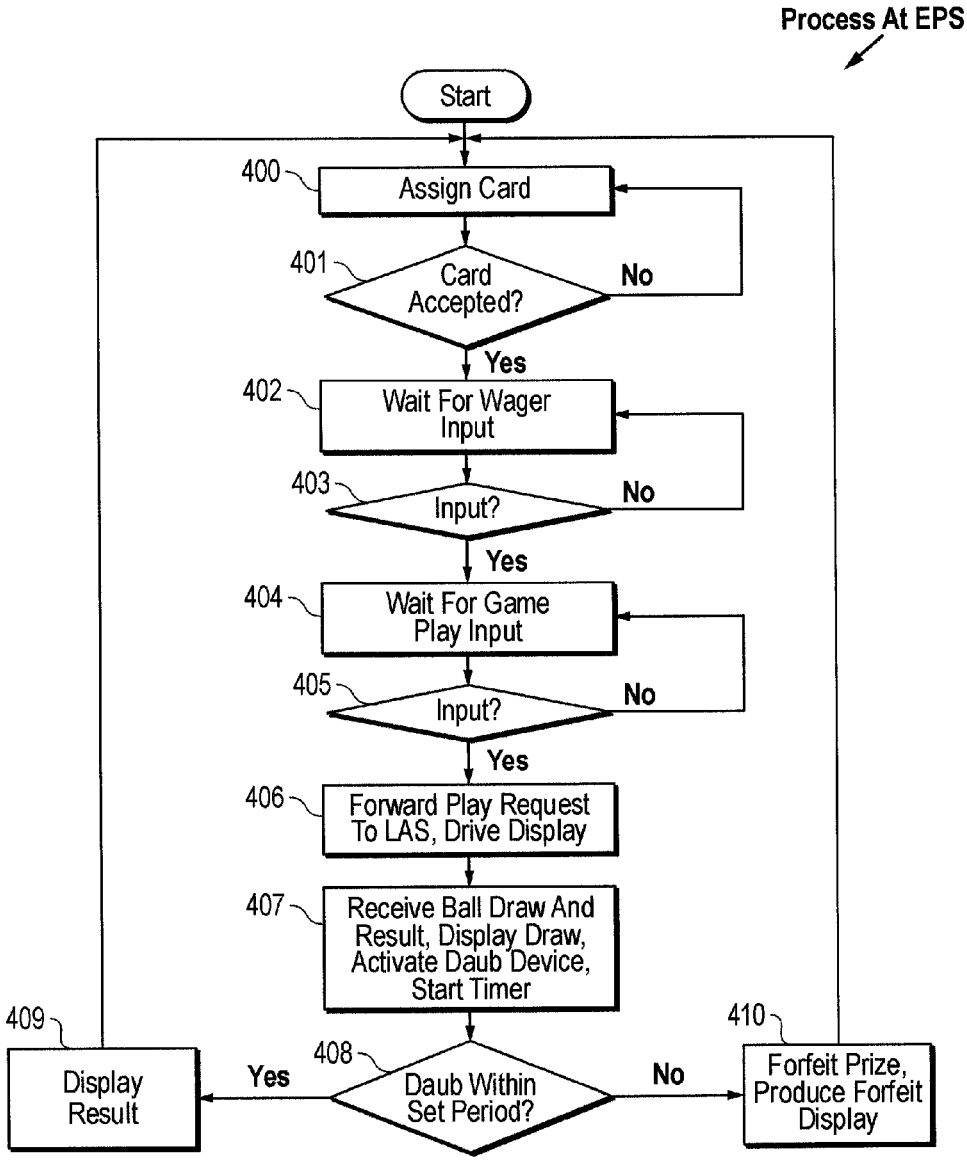
FIG. 4 is a flowchart providing a high level description of a process executed at the electronic player stations according to the present invention.

FIG. 4 shows a process that may be performed at an EPS 103 according to the invention. After EPS 103 is initialized and activated for use by a player, the process at the EPS includes assigning the player a bingo card as shown at process block 400. In some forms of the invention, this card assignment process may be performed each time the player desires to make a game play request through EPS 103. In other forms of the invention the card assignment process need only be performed once and then the player may continue to use the same bingo card for numerous different game play requests, but with the ability to obtain a different card as desired. Regardless of whether the card assignment process is performed for each play or for multiple plays, the player may have the option to accept or reject a presented card as indicated at decision block 401. Alternate forms of the invention may not give the player a choice in accepting or rejecting a bingo card. On the other end of the spectrum, an EPS 103 according to the present invention may allow the player to build their own card or select cards from a number of available bingo cards.

Each card that is assigned to the player according to the invention is associated with a game play request, and comprises a representation of a bingo card that includes some arrangement of symbols or designations. The bingo system shown in FIG. 1 may be played with the standard 5-by-5 grid bingo cards, 3-by-3 grid bingo cards, cards comprising a single straight line of spots or card locations, or cards having some other arrangement of spots. Regardless of the nature of the bingo card played in the particular game, the card is represented by a data structure. An example of the structure will be described below with reference to FIG. 11.

It will be appreciated that the card assignment step shown at process block 400 in FIG. 4 may require communications between the respective EPS 103 and its respective LAS 102 or the CGS 101. In particular, in order for the results of a bingo game for a particular card to be identified at one of the LASs 102 or the CGS 101, the respective LAS or the CGS must have a definition of the card that indicates the symbol or designation associated with each spot on the card. Making the card definition for a particular bingo card available to the component in the system that identifies the results of play for the particular bingo card may be handled in a variety of different ways within the scope of the present invention. In one preferred form of the invention, each EPS 103, each LAS 102, and the CGS 101 stores or has ready access to a bingo card definition file containing a large number of records each representing a particular bingo card and including a unique card identifier or index value. In this arrangement for storing card definitions, only the card identifier need be communicated between the system components in order for the system components to have a definition for the respective card. A system component having the card identifier for a particular card may simply look up the identifier in the card definition file and read the card definition associated with the identifier. For example, where a player selects a particular bingo card at an EPS 103, the EPS may communicate the card identifier to the respective LAS 102 or CGS 101, and the LAS or CGS may then use the card identifier to obtain the actual definition for the card, that is, the designations assigned to the various card spots.

Alternatively to including a card definition file at each of EPS 103, each LAS 102, and CGS 101, the various components may communicate the actual card definitions. Communicating the actual card definitions obviates a requirement for storing card definition files at the various system components but requires that more data be communicated between the various system components.

A card assignment process within the scope of the present invention may include additional actions or communications by the respective EPS 103 and the respective LAS 102 and/or CGS 101, depending upon the rules of play in the system. For example, the card assignment process may give the player at EPS 103 the option of defining his or her own bingo card or cards to place in play. In this situation, EPS 103 or some other component in the system may compare the card defined by the player to a predefined set of cards to locate an identifier for that particular card. Only the card identifier then needs to be communicated to the various components in the system to communicate the definition of the player's card assuming those components have access to a card definition table identifying each card representation by the assigned identifiers. Also, in situations in which players may define their own bingo card or cards, a system according to the present invention may include a process to ensure that two players do not have the same card in play in a particular game. This process may prompt the player to define a different card or may automatically return an even money result as discussed further below without actually entering the player in a bingo game.

In addition to the card assignment process indicated at blocks 400 and 401, the EPS process shown in FIG. 4 allows the player to enter a wager or card price for playing the card in a game offered through EPS 103. Process block 402 and decision block 403 indicate that EPS 103 waits for a wager input before proceeding on to the process. In preferred forms of the invention, the player may choose from a number of different wager levels or card price levels for each card the player places in play and these card price levels may be defined in terms of currency, credits, or in some other fashion.

Once the card is assigned to the player at EPS 103, and the price of the card or wager is defined, the card may be entered in a bingo game administered by the system 100 in which the respective EPS 103 is included. As indicated at process blocks 404 and 405 in FIG. 4, the EPS 103 may wait for a separate game play input or game play request entered by the player at the EPS, and only then proceed to forward the game play request to the other components of system 100. In other preferred forms of the invention, a separate input may not be required in order for the player to enter into a bingo game. For example, simply defining the wager may automatically enter the bingo card in a bingo game without any separate game play request, or, where the wager is predefined, the step of accepting a particular bingo card may enter the player in a bingo game. As yet another alternative, simply making a game play request at an EPS 103 may define a bingo card for the player, define a wager level, and send a request to enter that bingo card in a bingo game administered through the system.

Once the player has, in one fashion or another, made an input at EPS 103 to enter their card or cards in a bingo game administered through the gaming system (100 in FIG. 1), the EPS forwards a game play request to the respective LAS 102 as indicated at process block 406 in FIG. 4, and preferably drives a display showing some type of entertaining graphics pending the return of the result for the player's card(s) in the bingo game. For example, EPS 103 may be configured to display results associated with the underlying bingo game in terms of reel stop positions for a reel-type gaming machine (slot machine). For this type of result display, the step of driving the display at process block 406 may include showing a number of reels spinning to imitate the spinning reels one would see immediately after activating a traditional reel-type gaming machine. Alternatively, results from the bingo game may be displayed in some other entertaining fashion such as a horse or dog race for example, and the step of driving the display shown at process block 406 in FIG. 4 may include an initial portion of the race. In yet other forms of the invention, results may be displayed as in a traditional bingo game and the step of driving the display shown at process block 406 in FIG. 4 may include simply displaying the bingo card that has been assigned to the player and placed in play. Even where the results of the bingo game may be shown with entertaining graphics unrelated to the bingo game, a portion of the display at EPS 103 is preferably devoted to a representation of the bingo card in play and ball draw for the bingo game in which the card is entered.

The nature of the communication forwarding the game play request to LAS 102 will depend upon a number of factors. For example, the communication may include an actual card definition for each card that defines the respective player's card which is in play for the game. Alternatively, where card definition files are available at the various system components as described above, the communication may include a card identifier for each card placed in play and this identifier may be used to locate the actual card definition. In still other forms of the invention, the player's card or cards placed in play from EPS 103 may have been known to the LAS or CGS from the card assignment process shown at process blocks 400 and 401. In this case, the game play request sent to LAS 102 at block 406 in FIG. 4 may not include even an identifier for the card(s) in play, but merely some signal for the LAS to place the card(s) in play for the requesting player.

Regardless of how EPS 103 drives the display at process block 406 in FIG. 4, the EPS receives a ball draw for the game in which the player has been entered and, for each card placed in play, a result for the game play which has been identified at the LAS 102 or CGS 101 as will be described in detail below. The receipt of the ball draw and result is shown at process block 407 in FIG. 4. The result received at EPS 103 represents the result of the respective player's card in the bingo game in which the player's card has been entered. As in any bingo game the result is associated with some pattern and/or sequence of spots on the player's bingo card that have been matched by designations in the ball draw. However, it will be appreciated that the result communicated to EPS 103 at process block 407 is preferably some result code that represents the actual bingo result. The ball draw and result may be sent to EPS 103 separately or in a single communication. In either case, the preferred form of the invention displays the ball draw on the display associated with the EPS prior to the time the respective game result is displayed.

In some preferred forms of the bingo gaming system, the bingo player must claim their bingo prize associated with a winning result. In systems in which the player must claim their prize, the EPS process may include activating a prize claiming or daub input at EPS 103 in the event a game play returns a winning result. This prize claiming or daub input activation is included at process block 407 in FIG. 4 along with the activation of a timer which sets a time period for the player to actuate the prize claiming or daub input and claim the prize. In a preferred form of the process at EPS 103, the EPS also produces a display indicating to the player that they must take a particular action to claim their prize, and indicating or counting down the time remaining to claim the prize. This timer or countdown display may be in addition to or in lieu of the display initiated at process block 406. A countdown timer display according to the invention may be superimposed on the display initiated at process block 406.

If the player claims their prize by taking the appropriate action within the set period of time as indicated by decision block 408 in FIG. 4, EPS 103 displays the result of the game for the player as indicated at process block 409, and the gaming system awards the prize to the player. In the example described above in which the results may be displayed by reel-type or slot machine graphics, the display at EPS 103 may show reels stopped in particular positions that together correspond to the result achieved by the player in the bingo game. In the example where the results are shown by a horse or dog race, EPS 103 may show a particular horse or dog in a win, place, or show position corresponding to the result the player has achieved in the bingo game.

In the event the player at EPS 103 does not take the required action to claim the prize within the set period of time, the prize associated with the player's result in the bingo game may be forfeited as indicated at process block 410. In the case of a forfeited prize, EPS 103 may also produce a suitable display to indicate to the player that the prize associated with the play in the bingo game has been forfeited. Any forfeited prizes may be collected and applied to a progressive game offered through system 100 or may be collected for use as a charitable contribution. The forfeiture process may include subtracting a prize value from the player's account. This prize value may have been previously added to the player's account by system 100 automatically in response to the winning result.

Whether a prize has been forfeited as shown at process block 410 or has been claimed and the result displayed as shown at process block 409, the process at EPS 103 may return to card assignment steps 400 and 401 as shown in FIG. 4. As discussed above, it will be appreciated that the process may automatically assume that the player wishes to use the same card unless prompted for another card and/or may assume that the player wishes to make the same wager placed in the previous play. Thus, the process may return to a point in the process different from that shown in FIG. 4. A number of different options may be provided to the player at EPS 103 to allow the player to choose a different card or cards to enter in another bingo game administered through system 100.

In some instances, the result from the bingo game may not be associated with any prize. In these instances, the process at EPS 103 may not activate a daub or prize claiming input device, and not wait for an input before displaying the result. Rather, the process at EPS 103 may simply include displaying the non-winning result immediately after receiving the result from LAS 102 without further intervention on the part of the player.

It will be noted from FIG. 4 that participation in a bingo game offered through an EPS 103 can be thought of as a three-step process aside from any login step that may be required at the EPS. The first step includes the card assignment process and the buy-in or wager amount selection process as indicated at process blocks 400 through 403 in FIG. 4. In the second step, the player puts the card in play as indicated at process blocks 404 and 405 in FIG. 4. In the third step required to participate in a game, the player daubs the card once the bingo numbers have been drawn. This last participation step is indicated by the decision block 408 in FIG. 4. The course taken from decision block 408 turns upon whether the prize claiming or daub input has been entered by the player.

In some forms of the invention, the player's failure to enter a prize claiming or daub input may not result in the forfeiture of the prize, but rather cause the underlying bingo game to proceed with the ball draw (or additional numbers in the already defined ball draw sequence). In these forms of the invention, a player's failure to claim the game ending prize causes the underlying bingo game to continue with additional bingo numbers until another game ending winner is produced. This new game ending winner may then be given the opportunity to claim the game ending prize. If the player fails to enter the prize claiming or daub input at this point, the prize may be forfeited or the game may proceed again until another new game ending winner is determined.

In yet other forms of the invention, the EPS 103 may force the player to take a daubing action in order to proceed on to another game. Also, the daubing step may be defined broadly so as to ensure that a player takes the daubing step to claim their prize. For example, where a player card must be inserted into an EPS 103 in order for a player to participate in a bingo game offered through system 100, the act of removing the player card may be defined as an act of daubing a card if the EPS 103 is waiting for a daub input from the player.

Figure 5:
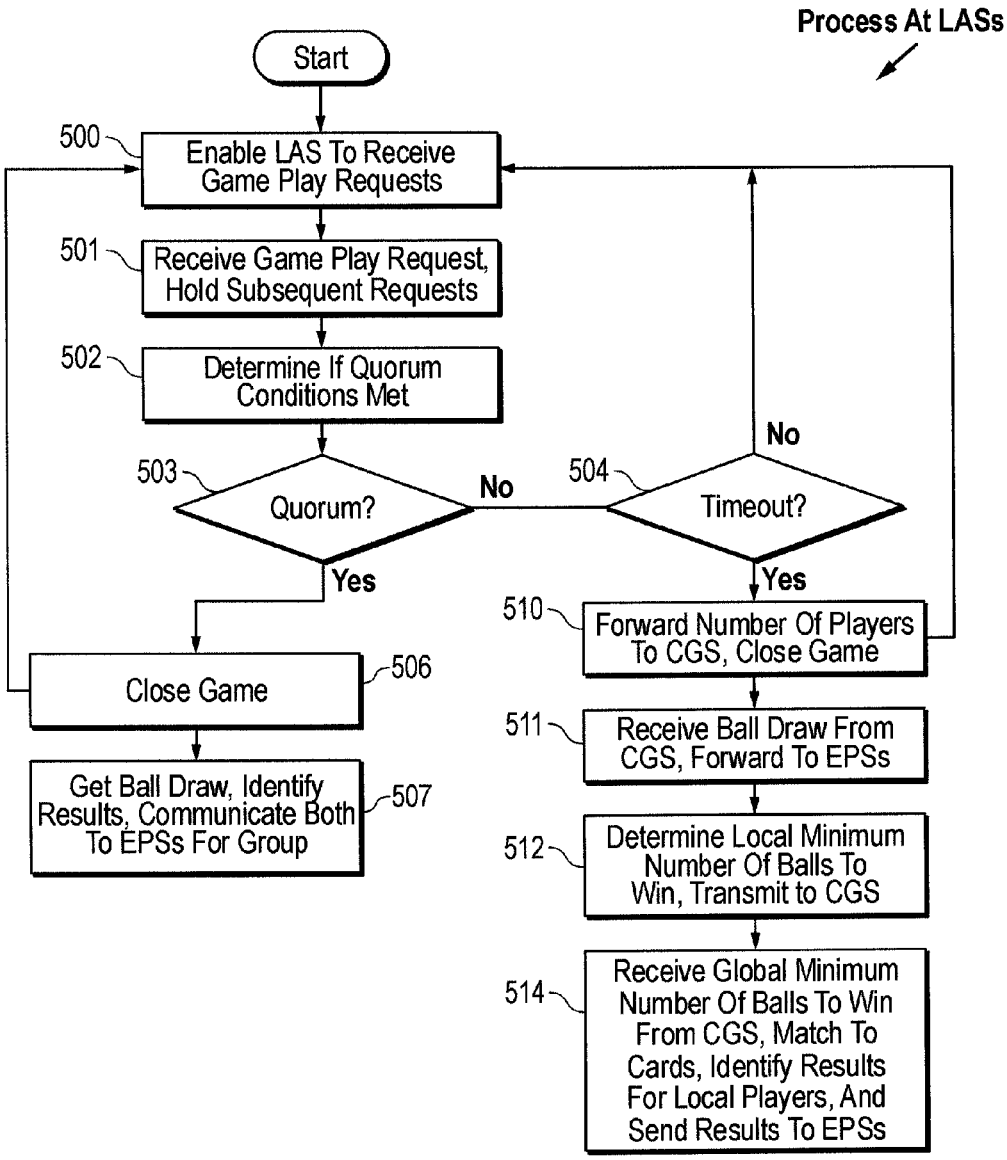
FIG. 5 is a flowchart providing a high level description of a process executed at the local area servers according to the present invention.
Figure 6:
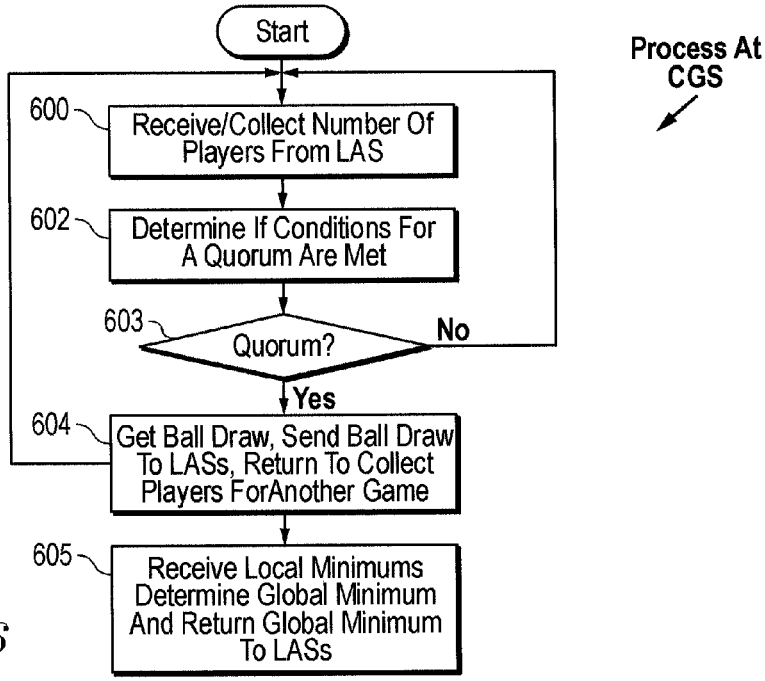
FIG. 6 is a flowchart providing a high level description of a process executed at the central game server according to the present invention.

FIGS. 5 and 6 may be used to describe one preferred arrangement for cooperation between the LASs 102 and the CGS 101 in system 100 shown in FIG. 1, and to describe the processes performed at the LASs 102 and CGS 101 in that arrangement. In this particular arrangement for cooperation between LASs 102 and CGS 101, a LAS may group players or game play requests for a game available through the system if the group may be produced in a timely fashion from game play requests received from EPSs 103 local to the respective LAS. The group of players or game play requests for a game administered through system 100 will be referred to in this disclosure as a quorum and will comprise some minimum number N of players that may be a fixed number, a range of numbers, or a number determined dynamically depending upon certain system operating parameters and/or the nature of the game play requests. In the arrangement shown in FIGS. 5 and 6, it is only if the respective LAS 102 cannot produce a quorum among local game play requests that the game play requests from different gaming sites are grouped by CGS 101 for the play of bingo games.

Referring now to FIG. 5, the respective LAS 102 is placed in a state in which it is enabled to receive game play requests from its respective EPSs 103 as indicated at process block 500. Upon receipt of a game play request as indicated at process block 501 (from one of its respective EPSs 103), LAS 102 may temporarily hold any subsequently received requests while the system checks for a local quorum. LAS 102 then checks to see if the predefined conditions for a quorum are met as shown at process block 502 in FIG. 5. The various processes that may be used to determine if the predefined conditions for a quorum have been met will be described in detail below with reference to FIGS. 9 and 10. If the predefined conditions for a quorum are not met as indicated at decision block 503, the process branches to decision block 504 and LAS 102 determines if the time for obtaining a local quorum has expired. If the end of the predetermined time set for obtaining a quorum locally from EPSs 103 has not expired, the process returns back to block 500 and LAS 102 is enabled to receive the next game play request.

If the predefined conditions for a quorum are met at decision block 503, the process branches to block 506 and LAS 102 closes the game with the currently collected game play requests and returns to process block 500 to begin collecting game play requests for a different bingo game. By closing the game, it is meant that the game play requests for a given bingo game to be played in the system have been selected and no further game play requests are entered in that bingo game. As shown at process block 507, LAS 102 then proceeds to conduct a bingo game for the collected group of game play requests. That is, LAS 102 produces or obtains a ball draw and identifies the results of the game by checking the ball draw against the bingo cards which have been entered in the game, each card being associated with a separate one of the game play requests. LAS 102 also communicates the ball draw to each EPS 103 from which a game play request in the group originated and communicates the result for each game play request in the group to the respective EPS from which the respective game play request originated.

If the predetermined conditions for a quorum have not been met locally as indicated at decision block 503 and the time has elapsed for obtaining a quorum locally as indicated by decision block 504, the process at LAS 102 branches to process block 510 at which point the LAS forwards the number of collected game play requests to CGS 101. LAS 102 also closes the game and returns to process block 500 to again begin the process of collecting game play requests in an effort to produce a quorum. The process at LAS continues by receiving a ball draw from CGS 101 and forwarding the ball draw to the EPSs 103 from which the group of game play requests originated as shown at process block 511. With the ball draw for the game at hand, LAS 102 proceeds to check the ball draw against each card in play in the game to determine a minimum number of balls to win the game among the local players playing through that LAS, and transmits that local minimum number of balls in the ball draw to CGS 101. These steps are shown at process block 512. As shown at block 514, LAS 102 then receives from CGS 101 a global minimum number of balls from the ball draw, matches the global minimum number of balls to the cards in play through that LAS to identify the result associated with each respective card, and distributes each result to the appropriate EPSs 103.

Referring now to FIG. 6, the process at CGS 101 that corresponds to the LAS process shown in FIG. 5 includes collecting or receiving the number of players for a game from the various LASs 102 in system 100 (FIG. 1). This receiving step is shown at process block 600 in FIG. 6. The number of players received at this step is the number communicated from each LAS 102 at process block 510 in FIG. 5. CGS 101 also determines if the conditions for a quorum have been met and shown at process block 602. Specific arrangements for determining whether quorum conditions have been met will be discussed below with reference to FIGS. 9 and 10. Regardless of how the quorum is determined, if the conditions for a quorum are met as indicated at decision block 603, CGS 101 produces or obtains a ball draw and, as shown at process block 604, sends the ball draw to the particular LASs 102 from which communications were received at process block 600. As shown at process block 605, CGS 101 then receives all local minimums from the various LASs 102. The local minimum information is the information transmitted according to process block 512 in FIG. 5. CGS 101 also then determines the global minimum number of balls from the draw to produce a win and transmits this global minimum number of balls to the various LASs 102 from which communications were received at process block 600. The various LASs 102 servicing game play requests for this particular bingo game may then identify and distribute results as indicated at process block 514 in FIG. 5.

It should be noted from FIG. 6 that if predefined conditions for a quorum are not met at decision block 603, the process returns to process block 600 to receive further communications from the various LASs in an effort to make a quorum for the play of a bingo game. Although not shown in FIG. 6, embodiments of the invention may include a timer feature that times out if a quorum is not produced within a certain period of time. Such a time out would cause CGS 101 to communicate back the LASs 102 that a game may not be completed. The LASs 102 may communicate to the requesting players at the various EPSs 103 to try again or the LASs may return an even money result to the requesting players as will be described further below. It should also be noted that even if conditions for a quorum are met for one group of collected game play requests at process block 604, CGS 101 still returns to process block 600 to begin collecting game play requests to make another quorum for another bingo game.

In the processes illustrated in FIGS. 5 and 6, CGS 101 receives from the LASs 102 only a number representing the number of players or game play requests available for grouping together to play a bingo game according to the invention. CGS 101 does not receive further information regarding the players such as the cards that the various players have placed in play through their respective game play requests. Thus, CGS 101 is unable to determine on which ball in the ball draw a game winner occurs and the CGS must cooperate with LASs 102 to determine a global minimum representing the number of balls to produce a winner among the various players grouped for the given bingo game. In alternate forms to the invention, CGS 101 receives from LASs 102 or EPSs 103 either the bingo card definitions themselves or the information necessary to determine the definitions of the cards in play for the bingo game. In this alternate arrangement, CGS 101 may identify the results of the bingo game and may communicate the results back to the LASs 102. This alternate arrangement obviates the need for the LASs 102 to identify results as indicated at process block 514 in FIG. 5 and eliminates some of the communications between the LASs 102 and CGS 101 as will be described further below in the alternate processes illustrated in FIGS. 7 and 8.

Figure 7:
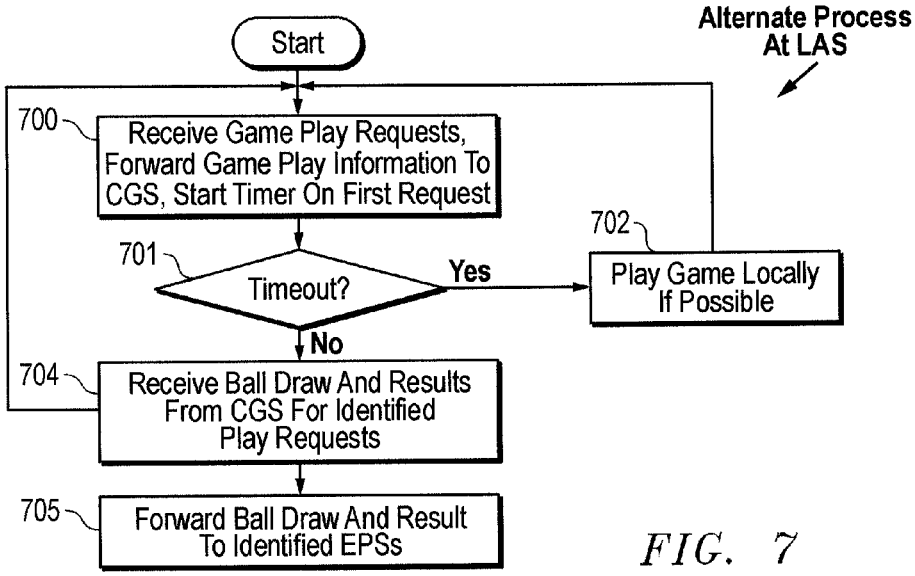
FIG. 7 is a flowchart showing an alternate process executed at the local area servers.

Referring now to FIG. 7, an alternate process at each LAS 102 within the scope of the present invention includes at process block 700 receiving a game play request from one of the EPSs 103 serviced by respective LAS and immediately forwarding the game play request to CGS 101 along with information associated with the request such as a card definition or card identifier from which the card definition may be determined. As shown at process block 700, the LAS process may also include starting a timer on the receipt of the first game play request from a local EPS 103 for a given game. If a timer set at process block 700 times out before CGS 101 returns a ball draw and results for the game play requests which have been collected and forwarded to the CGS as indicated at decision block 701, LAS 102 may attempt to play the game locally if possible as indicated at process block 702. A timeout may occur if the communications link has been broken with CGS 101, or if the communications link has been degraded in some fashion. In this case it is necessary for LAS 102 to attempt to play games with only local players. Of course, if quorums cannot be produced locally with sufficient speed, LAS 102 may simply notify the EPSs 103 that new games are not presently available, or if the situation is transient, return even money results to the requesting players as discussed further below.

In situations where no timer is used at LAS 102 or a timeout has not occurred at decision block 701, the LAS receives a ball draw for the game play requests it has forwarded to CGS 101 along with the results of the game for those game play requests/players. The actual communications between LAS 102 and CGS 101 may require that the ball draw is sent in one communication and the results are sent as a separate communication or communications, otherwise both the ball draw information and results for the game may be sent as a single communication. At process block 704, LAS 102 receives the ball draw and results for the collected number of game play requests that were forwarded to CGS 101. The process at LAS 102 then proceeds to forward the received ball draw to the EPSs 103 from which the collected game play requests originated, as shown at process block 705. LAS 102 also forwards the results for the various game play requests, that is, the game results, to the respective EPSs 103. It will be noted that once a ball draw and results have been received for one group of game play requests that have been forwarded to CGS 101, the process returns back to process block 700 and continues to receive and forward game play requests for another bingo game as indicated by the line returning from block 704 to a point in the process immediately below the starting point.

Figure 8:
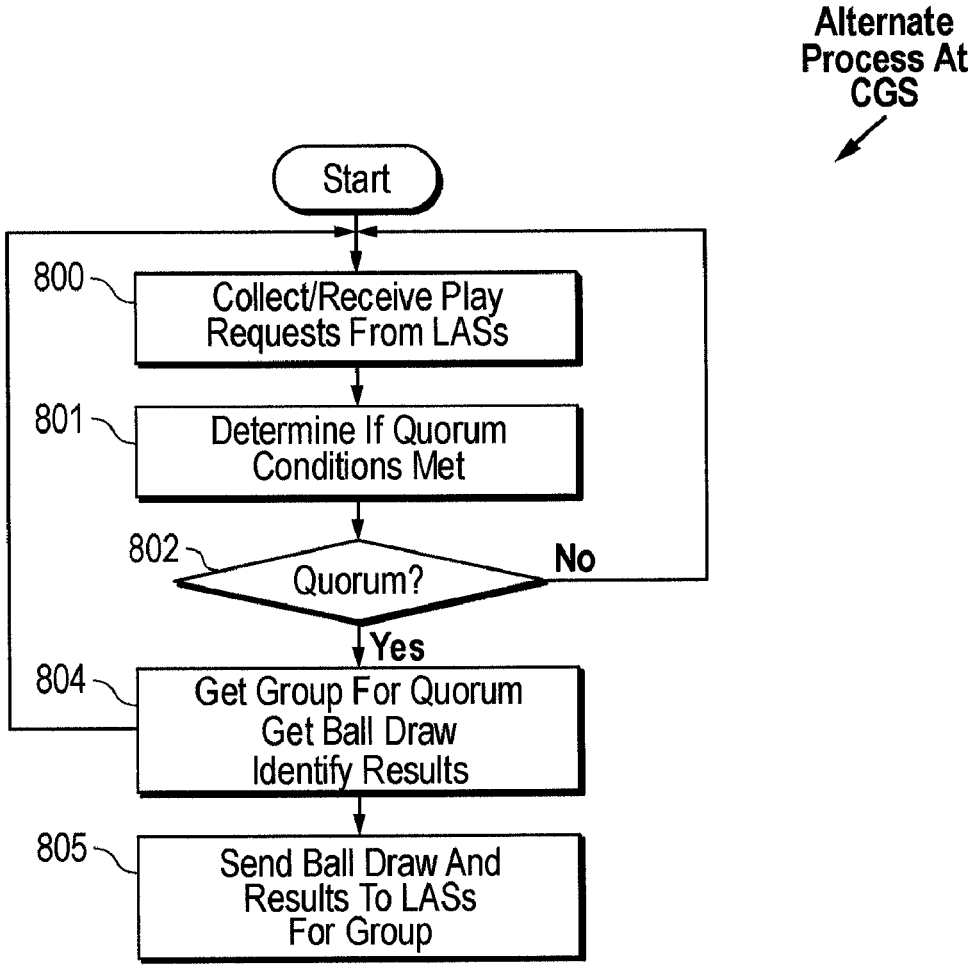
FIG. 8 is a flowchart showing an alternate process executed at the central game server in connection with the process shown in FIG. 7 for the local area servers.

FIG. 8 shows a process at CGS 101 that may be used in connection with the LAS process shown in FIG. 7. The process for CGS 101 includes collecting or receiving play requests from the various LASs 102 as shown at process block 800 in FIG. 8. CGS 101 also determines if predetermined quorum conditions have been met as shown at process block 801. Preferred alternatives for this quorum determining step will be described below with reference to FIGS. 9 and 10. If it is determined that conditions for a quorum have not been met at decision block 802, the process returns back to process block 800 to collect or receive further play requests from LASs 102. However, if conditions for a quorum have been met as indicated at decision block 802, CGS 101 collects or segregates the group of game play requests making up the quorum for a bingo game, obtains or produces a ball draw for the game, and identifies the results associated with the game by comparing the ball draw with the bingo cards associated with the game play requests which make up the quorum.

These functions are shown at process block 804 in FIG. 8. In addition to the other steps set out at process block 804, the process returns back to process block 800 to begin collecting game play requests from the LASs for another bingo game. As shown at process block 805 in FIG. 8, CGS 101 also communicates the ball draw and results for a given game to the LASs 102 implicated for the particular quorum that was determined at process block 801.

Figure 9:
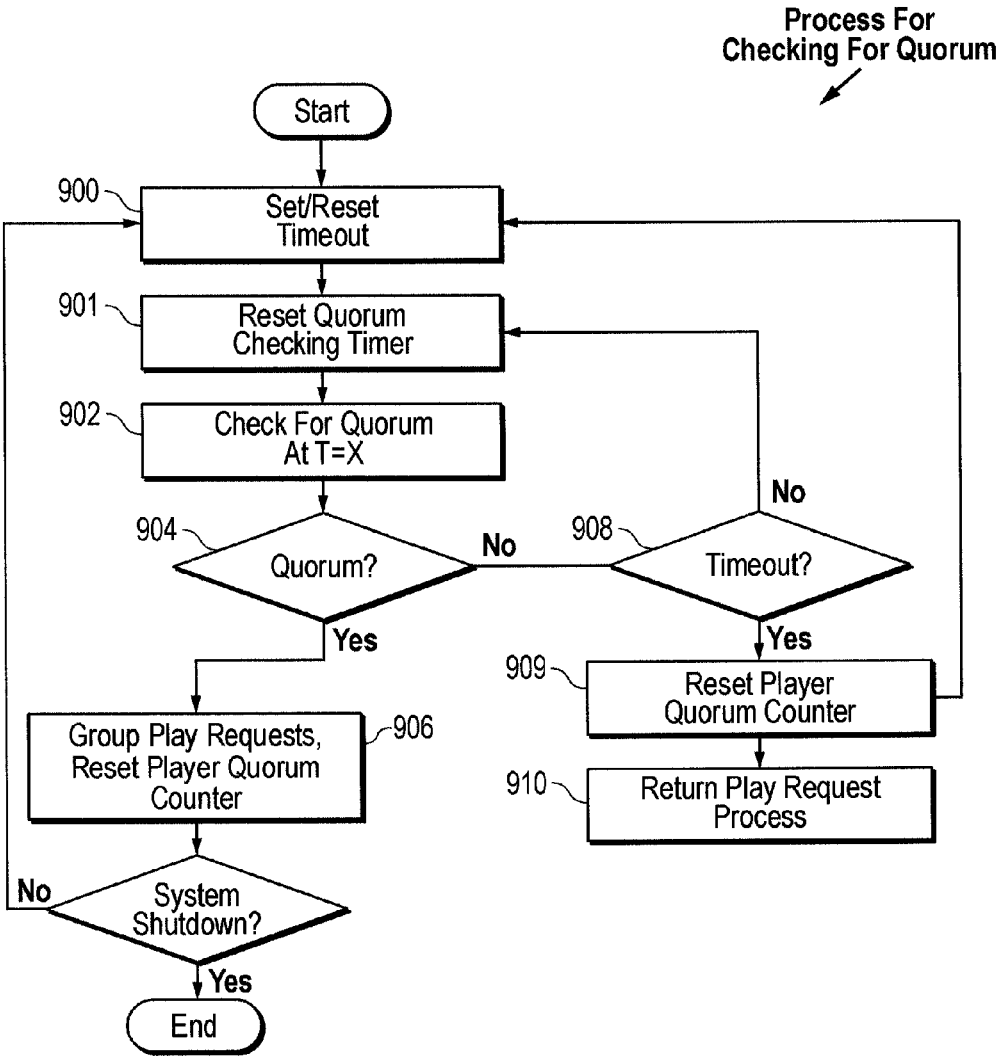
FIG. 9 is a flowchart showing a process for defining a set of players for a game in a bingo gaming system according to the present invention.

FIG. 9 shows one process according to the present invention for determining if a quorum exists for a bingo game to be played through system 100 (FIG. 1). This process starts with the step of setting or resetting a timeout timer as shown at process block 900. The timeout timer is used to keep track of the overall time that has elapsed since starting to collect a quorum in the system. The process next includes resetting a quorum checking timer as shown at process block 901. The quorum checking timer sets an incremental, predetermined period for checking for a quorum. This predetermined period may be very short for systems including many EPSs 103. For example, the quorum checking time increment may be on the order of 25 milliseconds. As shown at process block 902 in FIG. 9, the process next includes checking for a quorum at the end of the incremental, predetermined period of time set at process block 901. If, at decision block 904, the number of game play requests that have been collected at the end of the predetermined period meets the minimum number N to produce a quorum for playing a bingo game according to the invention, the process branches to block 906. At this point the component checking for a quorum, either a LAS 102 or the CGS 101, groups the collected game play requests representing the quorum. The process at block 906 may also include checking if a queue location has been allocated, and deallocating queue entries where the game play requests have been collected in a queue, and/or resetting a counter where a counter has been used to count game play requests. The process then returns to block 900 and resetting the timeout timer unless the system is being shut down.

If the number of game play requests which have been collected does not meet requirements for a quorum as indicated at decision block 904, the process proceeds to check the timeout timer to determine if the overall time limit for obtaining a quorum has elapsed. If the timeout timer has not expired as indicated at decision block 908, the process returns to block 901 and the quorum checking timer is reset. If a timeout has occurred as indicated at decision block 908, the process shown in FIG. 9 includes resetting the game play request queue if used and/or resetting a game play request counter as shown at process block 909. From block 909 the process returns back to process block 900 to reset the timeout timer and again attempt to collect a quorum to play a bingo game in the system. The process may also include performing a game play request return process as indicated at process block 910 in FIG. 9. This process is used to return game play requests that cannot be filled in a reasonable time according to the rules set for producing a quorum in the system. The process indicated at process block 910 may include sending instructions to the EPSs 103 causing them to produce a display indicating that the game play request and the associated wager is being returned and to try again. Alternatively, the game play request return process may include returning an even money result to the implicated players as will be discussed further below.

Figure 10:
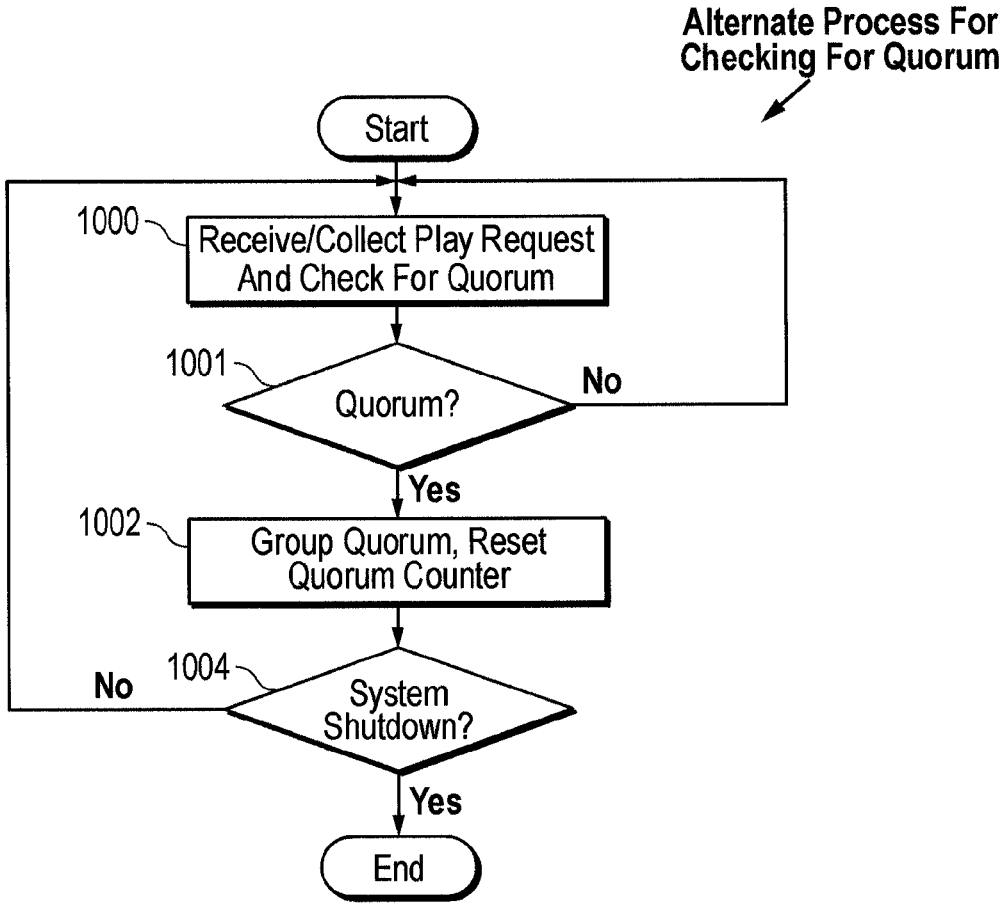
FIG. 10 is a flowchart showing an alternate process for defining a set of players for a game in a bingo gaming system according to the present invention.

FIG. 10 shows an alternate process for checking for a quorum of game play requests according to the present invention. In this alternate process, checking for a quorum is not conducted according to any time schedule. Rather, the alternate quorum checking process includes receiving or collecting a game play request and then immediately checking for a quorum as indicated at process block 1000. In one preferred arrangement for implementing the process shown in FIG. 10, each received game play request (or data representing the game play request) is stored in a first in/first out queue. Checking for a quorum in this implementation includes checking to see if all or a desired number of queue locations have been allocated, that is, store valid data for a received game play request. Instead of checking to see if the desired number of queue locations have been allocated, the quorum checking process may maintain a counter that provides a value indicating the number of received game play requests that are available for grouping for a bingo game according to the present invention. In this implementation, checking for a quorum includes comparing the number of game play requests received by the counter to see if that number is greater than or equal to some desired minimum number N for a bingo game. It will be noted that the same options for checking for a quorum at process block 1000 may be employed at process block 902 in FIG. 9, even though the checking is done at certain time intervals in that process as opposed to being done upon receipt of each game play request.

Regardless of how the system checks for a quorum of collected game play requests, if a quorum is not available as indicated at decision block 1001, the process returns to wait for the next game play request received. However, if it is determined that a quorum is available at decision block 1001, the process proceeds on to process block 1002 at which the quorum is formed, that is, a group of game play requests are identified for a particular bingo game according to the invention. The process at block 1002 may include reading the data from the queue locations for the game play requests in the group or quorum and deallocating those queue locations to make them available for additional game play request data. Where a counter is used to track the number of received game play requests, the process at block 1002 may include clearing or resetting the counter to start counting game play requests for the next quorum/bingo game. After process block 1002, the process returns to wait for additional game play requests or ends if the system is being shut down as indicated at decision block 1004.

Either of the processes or any other suitable process for determining if quorum conditions have been met may be employed by the LASs 102 at process blocks 502 and 503 in FIG. 5 or process block 702 in FIG. 7, or by CGS 101 at process block 602 in FIG. 6 or process block 801 in FIG. 8. Also, it should be noted that the invention is not limited to these illustrated processes for determining if conditions have been met for a quorum. In particular, the conditions of a quorum may be modified dynamically according to conditions in the gaming system and/or according to the nature of the game play requests that have been received. For example, during times of heavy activity in gaming system 100 shown in FIG. 1, the conditions for establishing a quorum may be dynamically increased to some optimum level. On the other hand, in times of low system utilization or where the LASs 102 attempt to create local quorums, the conditions for a quorum, for example the number of players/game play requests required for a quorum, may be decreased to some minimum level. The decrease in the number of game play requests needed to make a quorum may take into account the payouts available in the bingo game and the permissible delay between the time a player makes a game play request and the time that results are available to be displayed to the player in response to a game play request. In any event, decreasing the number of game play requests needed for a quorum to play a bingo game through system 100 in FIG. 1 may have the effect of reducing the time required to produce a quorum and thus reduce the maximum delay between the time the player makes a game play request, that is, puts his or her card in play, and the time they receive the result of the bingo game at the EPS 103.

It should further be noted that the number of game play requests grouped together for a bingo game according to the invention need not be a static number at any given time. Although the system may be configured to simply group a fixed number of game play requests when a quorum is achieved under the applicable quorum rules, some forms of the invention may be configured to group more or fewer game play requests depending upon other factors. For example, in either the quorum checking process shown in FIG. 9 or 10, the process of checking for a quorum will take some time even in a high speed processing system. During this time, the component which is performing the quorum check may receive one or more additional game play requests. To handle these additional game play requests, the system may employ a buffer to hold game play requests received during the quorum checking process. If the check detects a quorum for the play of a bingo game, the grouping process may take not only the collected game play requests but also any game play requests that have been stored in the buffer during the quorum checking procedure. Also, where the check for a quorum of collected game play requests indicates there is only a small number of requests below a desired minimum, and the number of received game play requests has remained static for a certain period of time, the system may be configured to declare a quorum with only the received number of game play requests even though it may be below the desired number for a quorum.

In operation of the present bingo gaming system, there may be situations in which a quorum suitable for playing a bingo game is not obtained in a reasonable time. The process shown in FIG. 9 for example shows a return game play request process at block 910. Any process for checking for a quorum used in the present system may include such a return game play request process. Rather than causing the EPSs 103 to ultimately provide some indication to the player that the game play request could not be honored, the LAS 102 or CGS 101 as the case may be, may instead send the EPSs 103 from which the game play requests originated a command or signal which causes the EPSs 103 to produce a display showing an even money result. That is, the EPSs 103 may display a result in which the payout is equal to the bet or wager. In this way, the player may not even know that his or her game play request could not be honored and thus they do not feel the frustration that could arise in that situation. Other implementations may return an even money result and cause the EPS 103 to display a message indicating that no game was played to obtain that result. A system embodying the principles of the present invention may display an even money result to a player any time the game play request cannot be honored for whatever reason or just in certain circumstances such as when a quorum cannot be produced in a certain maximum time or when there is some problem with the play request from the EPS (e.g. when the same bingo card is already in play in a given game as described above). The decision to force an even money result at an EPS 103 in lieu of an actual result in a bingo game is preferably made by a system component that identifies the result in the bingo game so as to avoid any conflict with an actual result in a game. However, the present invention may force an even money result display in lieu of an actual result at a component that may not identify the bingo game results. For example, an EPS 103 may be programmed to display an even money result after a certain period of time has elapsed at the EPS after the game play request was first communicated.

Many of the process steps described in FIGS. 4-10 are preferably performed by processing devices, such as those described in FIGS. 1-3, under the control of operational program code. For example, first collection program code can be used to collect a first group of game play requests at either an LAS 102 or the CGS 101 as described in relation to process blocks 501, 700, 800 and 1000. As discussed previously, the game play requests are collected from a number of EPSs 103. Quorum checking program code can be used to implement process blocks 502, 602, 801, 902, and 1000, which determine if the first group of game play requests collected by the first collection program code meets the predefined condition for a quorum. If the conditions for a quorum are met, then game program code conducts a bingo game with the first group of game play requests as described in relation to process blocks 507, 514, 702, and 804. While the game program code is conducting the game with the first group of play requests, second collection program code collects a second group of game play requests from the EPSs 103 as illustrated by the flow from process block 506 to both process blocks 500 and 507, and similar concurrent execution paths in FIGS. 5-8. In a preferred embodiment the game program code can begin conducting a second bingo game with the second group of game play requests before the first bingo game is completed.

In one form, the first quorum checking code includes comparison program code for comparing the number of game play requests collected in each respective game play group to a minimum number N of game play requests, as discussed in both FIGS. 9 and 10. Preferably, the comparison code implements process blocks 902 and 1000, first using counter program code to count the number of game play requests collected in each respective group of game play requests. As noted earlier with respect to process blocks 503, 702, 602, and 801, the minimum number N of game play requests required to produce a quorum may be determined dynamically based on operating conditions. These process blocks can be implemented using dynamic program code included in the quorum checking program code. In various forms the quorum checking program code also includes allocation program code for checking if a queue location has been allocated, as discussed in relation to process block 1002, timer program code for implementing process blocks 901, 902, and 908, receipt check program code to check for a quorum after each game play request is received, as discussed in relation to process block 1000, and linking code for associating game play requests with bingo card representations in association with the steps set out at 400 through 405 in FIG. 4.

FIG. 11 shows an example data structure for defining bingo game card faces for use in the gaming system 100 shown in FIG. 1. The data structure represents a file or card definition file 1101 that includes a number of records 1102, labeled record 0 through record X in the figure. The file may contain a very large number of card definitions, for example, three hundred thousand or more records 1102. Card definition file 1101 will generally also include header information 1104 that may include identifying information for the file and other data related to the card definition file. The first designation in each record (the designation in the leftmost column in FIG. 11) represents a card identifier or index that identifies the card face defined by the remainder of the record. The remainder of the record includes a list of designations representing the designations at the various spots on the card face. Using the example 3-by-3 bingo card face 1201 shown in FIG. 12 for the first card definition record 1102 in file 1101, the record would read 0, 8, 15, 1, 7, 2, 18, 5, 11, 24. In this structure, the 0 represents the card identifier or index, the designation "8" represents the designation in spot 1 of card 1201, the designation "15" represents the designation in spot 2 of card 1201, the designation "1" represents the designation in spot 3 in card 1201, and so forth for the remainder of the nine spots included in the card face. It will be noted from FIG. 12 that the spot identifiers are shown as numeric elements in the upper left corner of each spot in the 3-by-3 grid and the larger print number in the middle of each spot represents the bingo designation associated with that spot.

It will be appreciated that the invention may use card definition data structures different from those shown for purposes of example in FIG. 11. For example, the identifier may be located at any location within the data structure and the spots may not be in the order indicated in FIG. 11.

In some preferred forms of the invention, ball draws are produced by a suitable random number generator or pseudo random number generator in response to a ball draw request from a LAS 102 or the CGS 101 shown in FIG. 1. Automatic physical ball draw devices, partially automated physical ball draw devices, or manual ball draw devices may also be used to generate the desired ball draws used in the present invention. The ball draw device or random number generator may operate with sufficient speed to prevent significant delay in the play of the bingo game according to the present invention. However, it may be desirable in some implementations of system 100 shown in FIG. 1 to produce ball draws for use in the game and store the ball draws at least for a limited period of time. Ball draws stored in this fashion are substantially immediately available to the LAS 102 or CGS 101 requesting a ball draw in the operation of the present bingo gaming system.

Figure 13:
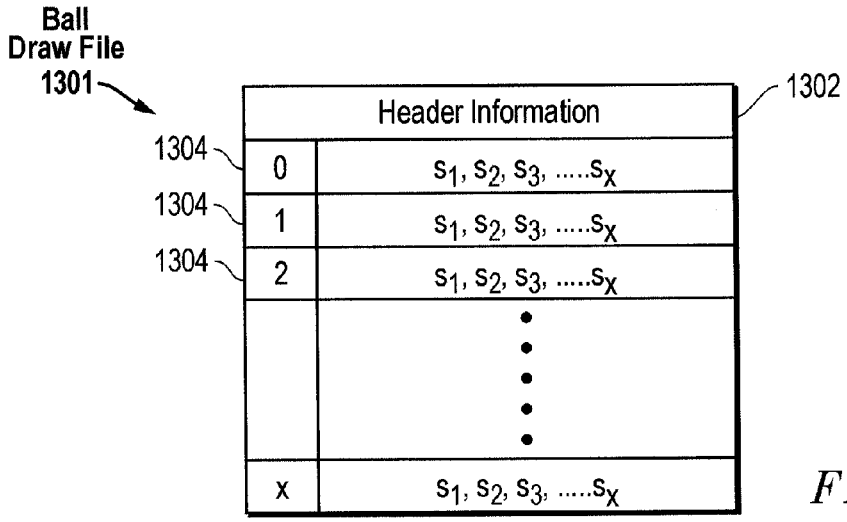
FIG. 13 is a diagrammatic representation of a ball draw file that may be used in certain versions of bingo gaming systems according to the present invention.

FIG. 13 shows an example of a data structure that may be used to store a number of ball draws for use in the present bingo gaming system. The data structure comprises a ball draw file 1301 that may include header information 1302 with identifying data and other data regarding the file. The ball draw file 1301 also includes a number of records 1304 labeled record "0" through "X" in FIG. 13. The leftmost value or entry in each illustrated record 1304 represents an identifier or index for the particular record. For example, the value "0" comprises the identifier for the first entry 1304 in ball draw file 1301. The remainder of each record includes a series of designations corresponding to or representing the bingo designations generated in a ball draw device or random symbol generator. The symbols $S_1$, $S_2$, $S_3$ through $S_X$ shown in FIG. 13 represent the designations making up the particular ball draw in the sequence they were drawn or generated. That is, $S_1$ represents the first ball drawn in the ball draw, $S_2$ represents the second ball drawn in the ball draw, and so forth. The number of designations needed for each ball draw will depend upon a number of factors known in the design of traditional bingo games.

If ball draw files such as the one illustrated in FIG. 13 are used in the system 100 shown in FIG. 1, one or more of such files may be stored at each respective LAS 102 in the event the LAS requests a ball draw. Also, one or more ball draw files may also be stored at CGS 101 for use by the CGS as described above. Some forms of the invention may also use ball draw files stored at the EPSs 103 to reduce the amount of data that must be communicated to the EPSs in the course of a game according to the invention. For example, in a situation in which CGS 101 requests a ball draw for a game played in the system 100 shown in FIG. 1, having a corresponding ball draw file stored at the EPSs 103 allows the CGS to communicate to the LASs 102 or EPSs an identifier for a ball draw rather than an entire record representing a ball draw.

Other forms of the invention may reduce the amount of data that must be communicated for a ball draw by using a pseudo random designation generator that responds consistently to a given seed or seed value to produce a particular string of random designations. In this form of the invention, the seed may be randomly determined at or for the LASs 102 or CGS 101. Only the seed needs to be communicated to the EPSs 103 because each EPS includes the pseudo random designation generator which can re-create the ball draw from the seed. The designations used in the invention may in any case comprise numbers or any other designations suitable for the play of a bingo game.

Figure 14:
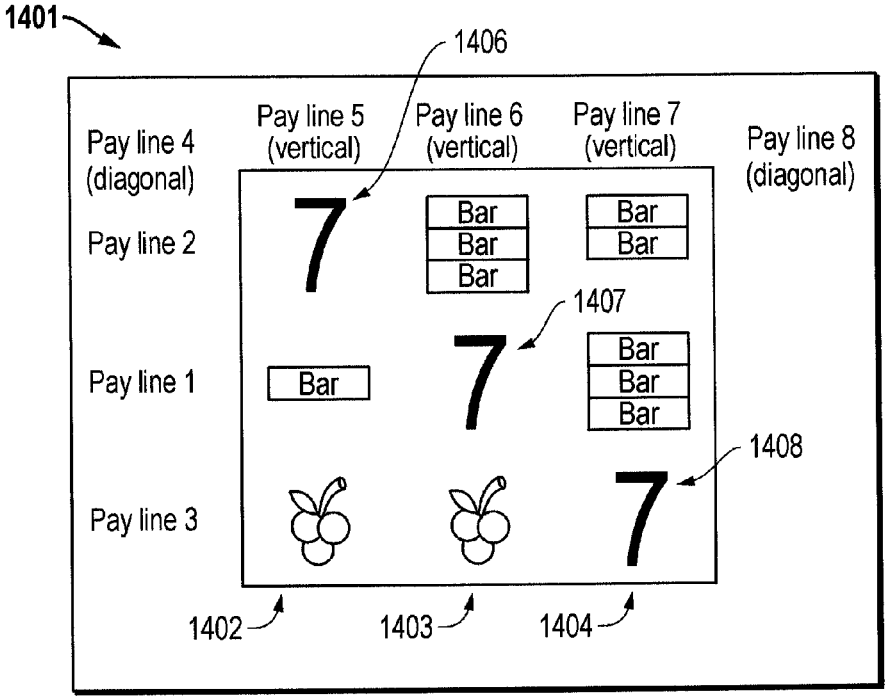
FIG. 14 is a diagrammatic representation of a reel-type display that may be used to display the result associated with one or more bingo games played according to the present invention.

The process described above at FIG. 4 relating to the process at an EPS 103 indicates that more than one bingo card may be placed in a play by a given player. That is, in some forms of the invention, a player may go through the card assignment process shown at blocks 400 and 401 to obtain multiple bingo cards to place in play simultaneously. The EPS 103 may be adapted in this alternative to simultaneously display multiple results in one or more bingo games, one result associated with each game play request, that is, each card placed in play. For example, the results of one or more bingo games may be displayed at EPS 103 as results in a three-reel slot machine as indicated in FIG. 14. The slot machine presentation 1401 showing reels 1402, 1403, and 1404 may include separate pay lines indicated as pay lines 1 through 8 in FIG. 14. Such a display would allow a player to place up to eight bingo cards in play simultaneously. The result associated with each bingo card for a given game may be shown as a result at one line of the three-reel slot machine. For example, pay line 1 in FIG. 14 may be associated with a first bingo card put in play by the player. Using the example reel stop positions shown in FIG. 14, the result displayed from a bingo game for the first card is a result that corresponds to the presentation "single bar," "7," and "triple bar." If the player had simultaneously put a second card in play in the bingo gaming system, the result associated with that card may be shown by the symbols shown at pay line 2 in FIG. 14. Again using the example reel stop positions shown in FIG. 14, the result displayed from a bingo game for the second card is a result that corresponds to the presentation "7," "triple bar," and "double bar." Each of the pay lines in the reel-type EPS display shown in FIG. 14 may represent the result associated with a single card placed in play by the player according to the invention.

In this implementation of the invention, the pay line representation shown at a given pay line may affect the presentation provided at another pay line. The result representations at the various pay lines must be consistent in order to properly display the results associated with the various cards that may be in play. For example if the player has simultaneously placed four bingo cards in play (or conceivably the same card four times simultaneously) with the result of each card shown at pay lines 1, 2, 3, and 4, respectively, the result representations at pay line 4 affects the result representations with each of the other pay lines. That is, the result representation shown at pay line 4 is made up of reel stop symbols that are also necessarily included in each of the other pay lines 1, 2, and 3. In the illustrated example of reel stop positions, the reel symbol "7" at position 1406 comprises the first symbol in the representation at pay line 4 and pay line 2. Similarly, the reel symbol "7" shown at position 1407 comprises the second symbol in pay line 4 and the second symbol in pay line 1, and the reel symbol "7" shown at position 1408 comprises the last symbol in pay line 4 and pay line 3. Thus, the reel stop symbols for the various active pay lines must be consistent with the result associated with the bingo card associated with the particular pay line.

In forms of the invention which allow players to make multiple plays simultaneously and use a single interrelated display for displaying the various results, such as the multiple line reel-type display shown in FIG. 14, it is desirable that each particular result that is possible for a given bingo card placed in play is capable of being represented on the display in several different fashions. The different types of displays for showing each different result are selected so that for any possible mix of results for the various bingo cards in play, at least one solution exists to show all results on the single interrelated display.

It will be noted that in the forms of the invention in which players may place multiple bingo cards in play simultaneously, or the same card in play multiple times, each card or instance of the same card may represent a single game play request. The resulting multiple game play requests made by a player putting multiple cards, or multiple instances of the same card in play simultaneously may be grouped in a single bingo game according to the invention or may be grouped in multiple different bingo games, depending upon the particular process for grouping game play requests to produce a quorum according to the invention.

Figure 15:
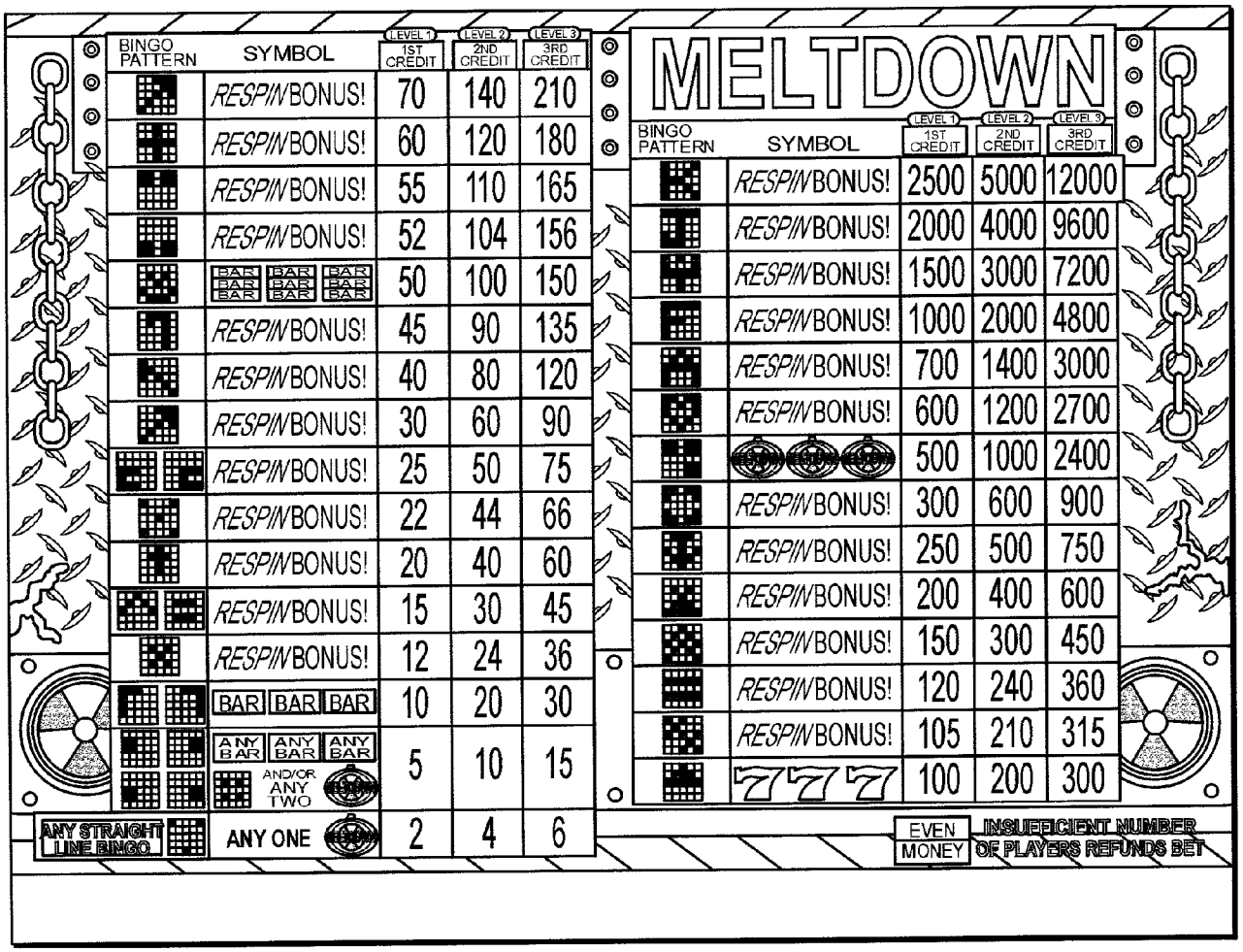
FIG. 15 is a representation of a payout table that may be used for a bingo game played through the gaming system shown in FIG. 1.
Figure 16:
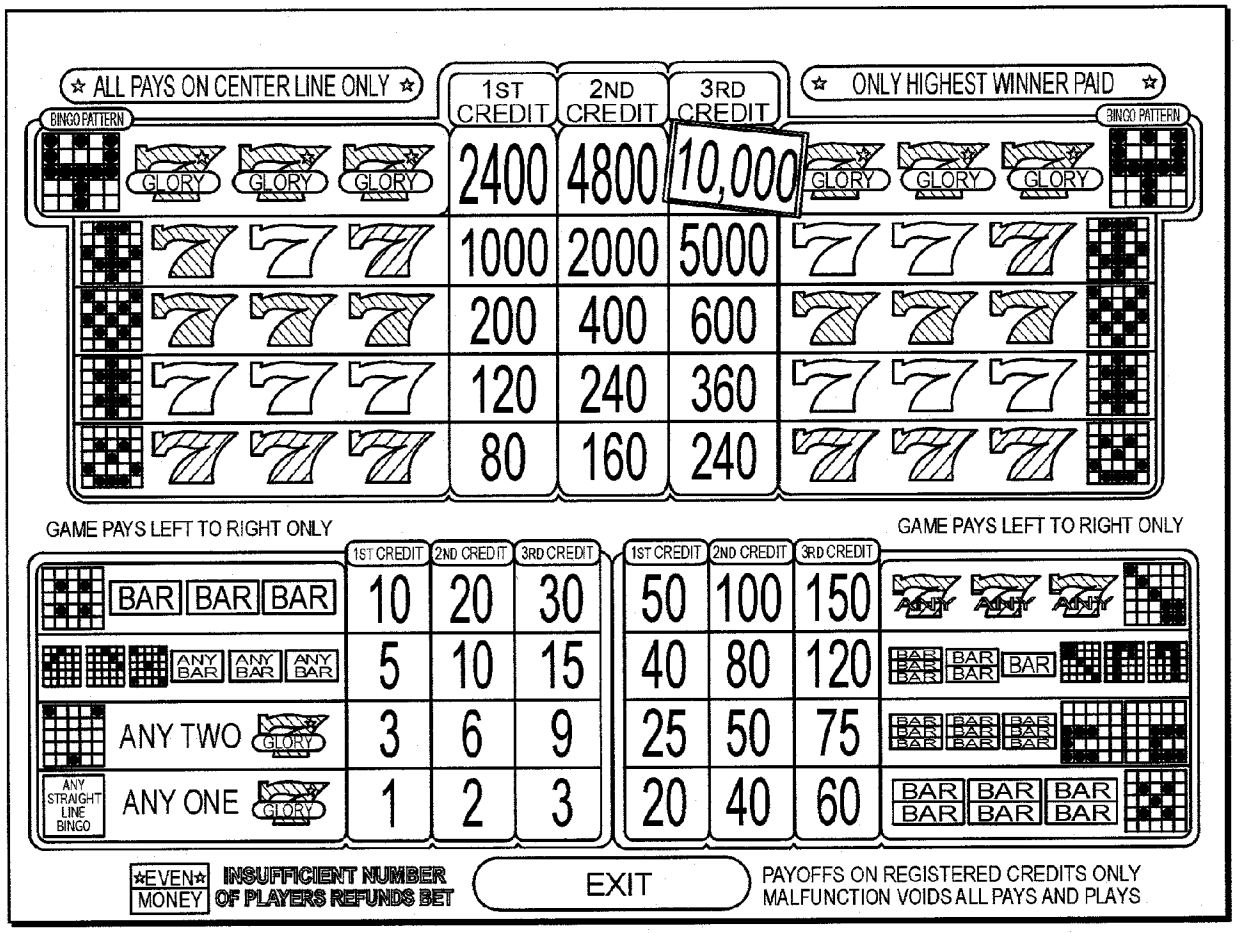
FIG. 16 is a representation of an additional payout table that may be used for a bingo game played through the gaming system shown in FIG. 1.

FIGS. 15 and 16 show examples of payout tables that may be used in displaying results of bingo games administered through the present gaming system. These payout tables are each associated with a specific type of reel-type game display or presentation. It will be noted that each prize level is associated with one or more bingo patterns that are each mapped or associated to that prize level. The payout table also shows the reel stop positions that are associated with each prize level/bingo pattern set. That is, if participating in the system 100 through an EPS 103 implementing the illustrated game presentations, achieving a particular bingo pattern in the gaming system will be shown on the EPS by a reel stop arrangement corresponding to the particular bingo pattern. This reel-type display is preferably in addition to an actual bingo card display also shown at the EPS 103 either simultaneously or otherwise.

It will be noted that the various EPSs 103 included in gaming system 100 shown in FIG. 1 may each be adapted for a particular display or presentation, and that the system may host many different types of game presentations. For example, a single system 100 may include EPSs 103 adapted to provide the display indicated by the payout table in FIG. 15 while other EPSs in the system may be adapted to provide the display indicated by the payout table in FIG. 16. All of these EPSs 103 submit game play requests for the very same bingo games. That is, a bingo game played according to the present invention may be played with, for example, seven game play requests originating from EPSs 103 adapted to provide the display indicated in the payout table shown in FIG. 15 and eight game play requests originating from EPSs 103 adapted to provide the display indicated in the payout table shown in FIG. 16. This multiple game presentation arrangement is facilitated by requiring the same game ending pattern for each EPS 103, regardless of the presentation it may provide. The bonus prizes available in the bingo game and the patterns that provide those bonus prizes may vary dramatically from one game presentation, that is, one EPS 103, to the next. Thus, in a particular bingo game played through system 100, the prize awarded to a particular bingo pattern achieved for a game play request will depend upon the particular EPS 103 from which the game play request originated. Furthermore, game play requests at different buy in levels may all participate in the same bingo games. For example, a given bingo game according to the present invention may be played by five players at a one credit buy in level, six players at a two credit buy in level, and four players at a three credit buy in level.

Example I

A particular bingo gaming system according to the present invention requires a fixed number of players to log on to a gaming network such as shown in FIG. 1 via player stations such as EPSs 103 in order for the game to start and continue. A preferred system requires at least 15 players, other versions could require a minimum of two or more players depending on the game parameters. The game is designed to create competition between players from all over the country who are gathered together in games via the network such as the network shown in FIG. 1. However, if not enough players enter a game during a buy-in period for a bingo game administered through the system, the bingo game does not start and any wagers placed by the players are refunded. Such a buy-in timeout arrangement and game play request return process is described above in connection with process block 910 in FIG. 9. After the game play request return process, the players can attempt to get into the next game offered through the system.

The gaming system drives several different reel-type game results displays. The bingo games played through the system can be played at multiple simultaneous levels of buy-in with each level of buy-in paying a prize amount in relation to the price of the card purchased. The card prices are indicated in terms of credits. Participation is a three-step process, select a buy-in amount, put card in play, and daub the card once the numbers for the bingo game are drawn.

In the first step, after the player inserts his or her player card into the player station (such as EPS 103), the player station displays a bingo card to the player. This is the card the player will be playing in the game. If the player wishes, they can touch the card represented on the player station touch screen display to select a new card and repeat that process until they get one they like. The player will then continue to play this card in all games until they elect to stop playing or switch cards by touching the card again. A player then selects the price of the card (wager) he or she wishes to play. On a $0.25 denomination electronic player station the player can purchase cards that cost one credit ($0.25), two credits ($0.50), three credits ($0.75) and so on up to eight credits ($2.00) or more.

In the second step, the player touches a control at the player station, such as a button on the front of the station or a button defined on the station touch screen to put the card in play. The player station immediately displays the card to the player and continues to display it until the game is over. Once sales for the game are closed, numbers are determined using an electronic ball drawer and displayed on the display associated with the player station. In this game, as in most bingo games, the symbols or designations used in the game are integers between 1 and 75. All the numbers called in the game are displayed on the player station display in the order they were called.

In the third step, the player must either hit a daub button on the player station or a daub button defined on the player station touch screen to daub the numbers they have covered on their card and claim their prize. If the player fails to daub their card within a specified short time period (3-10 seconds), any prizes they may have won during the game are forfeited to a progressive prize or to a fund that is given to a charity. If the player has not covered a prize-winning pattern, skipping the daub step has no effect.

During the game, numbers (bingo symbols/designations) are called until the first player in the game covers a previously determined, game-ending pattern. Once a player covers the game-ending pattern, no further numbers are drawn. The player or players (in the event of a tie) that first match the previously determined, game-ending pattern wins the must-go prize. The must-go is the only prize that is guaranteed to be awarded in every game, so players compete to be the one that gets the must-go prize. Bonus prizes are paid for matching specific patterns in the first 30 numbers (symbols) called, but if fewer than 30 numbers are required for a player to cover the game-ending pattern then only that quantity of numbers will be called. When more than 30 drawn numbers are required before a card in play achieves a game-ending pattern, the only prize payable for matching a pattern after 30 drawn numbers is the must-go prize.

The player can purchase and play a single card every six-to-ten seconds (average is expected to be about 10 seconds). During light periods of play on the linked network, such as the early hours of a weekday morning, play can take several seconds longer, due to the requirement for having a minimum number of cards in play to have a game.

Game results can be shown, for example, on a multicolored bingo card or as spinning reels with the symbols on the reels corresponding to various game outcomes. Game results could also be shown as a car race with the winning car colors corresponding to the game outcome.

In the play of the game, bingo cards are electronically generated and stored in a central "game host" computer database (such as at CGS 101 in FIG. 1). Before any cards are distributed, the deck is "shuffled" to order the cards in a random sequence, which determines the order in which they will be distributed. Players select the buy-in amount they wish to spend for the game and the card is then put in play by the player through the respective player station. Each card is immediately displayed on the respective player station so the player can see the card they are playing in the game after log in. Once sales have closed for a game, the central game host computer requests a sequence of numbers from the electronic ball drawer. The draw sequence is communicated from the central host computer to each player station and displayed there for the player to see.

When the number that produces the potential game-winning pattern is drawn, number (bingo symbol/designation) drawing stops. Bonus prizes are awarded for matching various patterns in the first 30 numbers (symbols/designations) drawn. If fewer than 30 drawn numbers are required for any player in the game to achieve the game-ending pattern, then only that quantity of drawn numbers is used to determine the bonus prizes.

The bingo game may be played using a traditional five-by-five bingo card, with no free space, using the following assumptions:

(a) Quantity of Numbers (symbols) drawn until the game-ending pattern is achieved is between 3 and 75 numbers.

(b) Game Ending, Winning Pattern is a Triangle (an inverted large three spot triangle), although any suitable pattern may be defined as the game-ending pattern.

(c) Prize payout is approximately 95% (Note: an individual game will pay from 5% to 4000%, but on average 93-97%.

(d) Card price choices: $0.05, $0.10, $0.25, $1.00, and $5.00

In addition to the game-ending pattern, additional designated patterns can be covered in order to win a bonus prize. The jackpot bonus prize is paid in some games on the cards that match an upright letter "M" pattern. Different patterns may pay the same prize. In the instance where a covered card contains more than one winning pattern, only the pattern paying the highest prize may be claimed and paid. This includes the game-ending pattern. If a card contains both the game-ending pattern and another, higher paying pattern, the higher prize amount is paid and the game ends.

The number of prize levels and the specific prizes paid for matching predetermined patterns in the game varies according to the specific game type the player has chosen. For example, a particular presentation may include 30 prize levels based on patterns achieved when up to 30 numbers have been drawn. Another presentation may have 64 prize levels for example.

Selected bingo games may be offered on the bingo gaming system with progressive prizes. Players compete for local, regional, and national jackpots by participating in games eligible for the prizes. The size of these progressive prizes increase based on participation until someone wins them.

Example II

Another gaming system within the scope of the present system is similar to the system described in Example I. Games follow the same sequence used in traditional bingo games as in Example I. The system also requires players to log on to the network via the player stations such as EPSs 103 in order for the game to start and continue. Under normal circumstances the system requires 15 players to play a bingo game; however, the game may be played by as few as 5 players locally between players at an individual hall in rare cases when there are less than 15 players on the network. If not enough players enter a game during the buy-in period, the game does not start and the players' money is refunded. The players can then attempt to get into the next game.

Example II may be played with several game results displayed at different EPSs 103 as in Example I, and players participate at multiple simultaneous levels of buy-in with each level of buy-in paying a prize amount in relation to the price of the card purchased. Participation is a multi-step process, with the card selection process, buy-in amount selection, and process of placing the card in play, identical to that described in Example I.

However, rather than requiring that a winning player daub their card within a certain time to claim their prize associated with a game play, an EPS 103 in this alternative example of the invention forces a winning player to daub their card before they may proceed on to another game. Once a game has begun the player may hit the daub button or touch the touch screen to daub their card. Removing the player's identification or player card may also constitute a daub. Thus, the player is forced to daub their card even if they simply remove their player card and do not attempt to enter further game play requests through the EPS 103.

During the game, numbers (symbols) are called until the first player in the game covers a previously determined, game-ending pattern. Once a player covers the game-ending pattern, no further numbers are drawn. The player or players (in the event of a tie) that first match the previously determined, game-ending pattern win(s) a must-go prize. The must-go is the only prize that is guaranteed to be awarded in every game, so players compete to be the one that gets the must-go. Bonus prizes are paid for matching specific patterns in the first 30 numbers (symbols) called, but if fewer than 30 numbers are required for a player to cover the game-ending pattern then only that quantity of numbers will be called. When more than 30 drawn numbers are required before a card in play achieves a game-ending pattern, the only prize payable for matching a pattern after 30 drawn numbers is the must-go prize.

As in Example I, game results can be shown on a multicolored bingo card and spinning reels with the symbols on the reels corresponding to various game outcomes may be added to the display. However, in this example system "speed stop" may be enabled to stop the game graphics as soon as the game is concluded. This speed stop feature causes the representation of spinning reels to stop at an arrangement to show the appropriate result immediately or at least more quickly after the result is known at the EPS 103. This is in contrast to an implementation in which the representation of spinning reels continues for some set time and then appears to stop at a particular arrangement to display the appropriate result.

The above described preferred embodiments are intended to illustrate the principles of the invention, but not to limit the scope of the invention. Various other embodiments and modifications to these preferred embodiments may be made by those skilled in the art without departing from the scope of the invention. For example, a system according to the present invention may include components other than those shown for purposes of example in FIG. 1. In particular, some gaming systems may require that players open an account at a point of sale terminal prior to logging in to the system and playing games at the various EPSs 103. Also, some preferred forms of the invention may include an intermediate computer or controller in communication with both the LAS 102 at a gaming facility and the EPSs 103 and point of sale terminals at the gaming facility. Several different intermediate computers or controllers may be configured in the system at a gaming facility, each dedicated to servicing a different set of EPSs 103 and point of sale terminals. These intermediate computers may help facilitate communications between the EPSs 103 and the LAS 102 and between the point of sale terminal and the LAS 102, and may also handle accounting and credit management functions in the system.

As used herein, whether in the above description or the following claims, the terms "comprising," "including," "carrying," "having," "containing," "involving," and the like are to be understood to be open-ended, that is, to mean including but not limited to. Only the transitional phrases "consisting of" and "consisting essentially of," respectively, shall be considered exclusionary transitional phrases, as set forth, with respect to claims, in the United States Patent Office Manual of Patent Examining Procedures (Eighth Edition, August 2001 as revised September 2007), Section 2111.03.

Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The invention claimed is:

1. A method including:

(a) collecting game play requests from a number of player stations into a first group of game play requests at a gaming server, wherein:

(i) each game play request in the first group is made in response to a respective input from a respective player at a respective one of the player stations;

(ii) each game play request in the first group constitutes a request to enter a bingo game, the bingo game being one of a number of bingo games played at the gaming server;

(iii) each game play request in the first group is sufficient to enter a respective wager from the respective player in the bingo game; and (iv) each game play request in the first group is entitled to receive a respective result for the bingo game, the result sufficient to 1) indicate no prize was awarded, 2) award the respective player a respective prize, or 3) award the respective player the respective prize contingent on receiving a player daub input for the respective game play request;

(b) in memory at the gaming server, associating each game play request in the first group with a respective bingo card representation;

(c) determining if the first group of game play requests meets a predefined condition for a first quorum required to conduct a first bingo game, the predefined condition for the first quorum including a minimum number of game play requests in the first group of game play requests;

(d) in response to meeting the predefined condition for the first quorum, conducting the first bingo game at the gaming server with the first group, the first bingo game being conducted by matching a plurality of bingo designations against the bingo card representations stored and determining the presence of one or more winning patterns;

(e) returning the respective result for the first bingo game responsive to each game play request in the first group, and awarding a credit award redeemable for money to each player whose respective game play request results in a winning pattern, and who daubs if a daub is required, as determined in the conduct of the first bingo game;

(f) collecting game play requests from the number of player stations into a second group of game play requests at the gaming server while conducting a portion of the first bingo game, wherein:

(i) each game play request in the second group is made in response to a respective input from a respective player at a respective one of the player stations;

(ii) each game play request in the second group constitutes a request to play in one of the bingo games played at the gaming server;

(iii) each game play request in the second group is sufficient to enter a respective wager from the respective player in the bingo game; and (iv) each game play request in the second group is entitled to receive a respective result for the bingo game, the result sufficient to 1) indicate no prize was awarded, 2) award the respective player a prize, or 3) award the respective player the prize contingent on receiving a player daub input for the respective game play request;

(g) while conducting a portion of the first bingo game, determining if the second group of game play requests meets a predefined condition for a second quorum; and (h) dynamically determining the minimum number of game play requests required to establish the first quorum, the dynamic determination being based upon system utilization conditions.

2. The method of claim 1 wherein dynamically determining the minimum number of game play requests required further comprises decreasing the number of game play requests required to make the first quorum taking into account the payouts available in the first bingo game.

3. The method of claim 1 wherein dynamically determining the minimum number of game play requests required further comprises decreasing the number of game play requests required to make the first quorum taking into account a permissible delay between a time a player makes a game play request and a time that results are available to be displayed to the player in response to a game play request.

4. The method of claim 1 further including, in a time of low system utilization, decreasing conditions for the second quorum, including the number of game play requests required for the second quorum, to a minimum level before determining if the second group of game play requests meets the condition for the second quorum.

5. The method of claim 1 wherein the step of determining if the first group of game play requests meets the predefined condition for the first quorum includes the step of checking if a queue location has been allocated.

6. The method of claim 1 wherein the step of determining if the first group of game play requests meets the predefined condition for the first quorum includes the step of checking for the first quorum at the end of a predetermined period of time.

7. The method of claim 1 wherein the step of determining if the first group of game play requests meets the predefined condition for the first quorum includes the step of checking for the first quorum in response to the collection of each respective game play request.

8. The method of claim 1 further including, while at least a portion of the first bingo game is being conducted, beginning to conduct a second bingo game at the gaming server with the second group of game play requests in response to meeting the predefined condition for the second quorum.

9. The method of claim 1 wherein a respective player station communicates a respective bingo card representation to the gaming server for associating with each respective game play request.

10. The method of claim 1 wherein the gaming server stores a group of bingo card representations and wherein each respective gaming machine communicates a respective card identifier to the gaming server, each respective card identifier for associating a respective bingo card representation with each respective game play request.

11. A system including:

a number of player stations, each player station for producing game play requests and presenting game results;

a gaming server in communication with the player stations over a network, the gaming server being adapted for:

(a) collecting game play requests from the number of player stations transmitted over the network into a first group of game play requests at a gaming server, wherein:

(i) each game play request in the first group is made in response to a respective input from a respective player at a respective one of the player stations;

(ii) each game play request in the first group constitutes a request to enter a bingo game, the bingo game being one of a number of bingo games played in the system;

(iii) each game play request in the first group is sufficient to enter a respective wager from the respective player in the bingo game; and (iv) each game play request in the first group is entitled to receive a respective result for the bingo game, the result sufficient to 1) indicate no prize was awarded, 2) award the respective player a respective prize, or 3) award the respective player the respective prize contingent on receiving a player daub input for the respective game play request;

(b) in memory at the gaming server, associating each game play request in the first group with a respective bingo card representation;

(c) determining if the first group of game play requests meets a predefined condition for a first quorum required to conduct a first bingo game, the predefined condition for the first quorum including a minimum number of game play requests in the first group of game play requests, such minimum number of game play requests being dynamically determined by the gaming server based upon utilization of the system;

(d) in response to meeting the predefined condition for the first quorum, conducting the first bingo game at the gaming server with the first group of game play requests, the first bingo game being conducted by matching a plurality of bingo designations against the bingo card representations stored and determining the presence of one or more winning patterns;

(e) returning the respective result for the first bingo game responsive to each game play request in the first group, and awarding a credit award redeemable for money to each player whose game play request results in a winning pattern, and who daubs if a daub is required, as determined in the conduct of the first bingo game;

(f) collecting game play requests from the number of player stations into a second group of game play requests at the gaming server while conducting a portion of the first bingo game, wherein:

(i) each game play request in the second group is made in response to a respective input from a respective player at a respective one of the player stations;

(ii) each game play request in the second group constitutes a request to play in one of the bingo games played in the system;

(iii) each game play request in the second group is sufficient to enter a respective wager from the respective player in the bingo game; and (iv) each game play request in the second group is entitled to receive a respective result for the bingo game, the result sufficient to 1) indicate no prize was awarded, 2) award the respective player a respective prize, or 3) award the respective player the respective prize contingent on receiving a player daub input for the respective game play request; and (g) while conducting a portion of the first bingo game, determining if the second group of game play requests meets a predefined condition for a second quorum.

12. The system of claim 11 wherein the gaming server is further adapted to determine if a respective group of game play requests meets the predefined condition for conducting the bingo game for the respective group of game play requests by checking if a queue location has been allocated.

13. The system of claim 11 wherein the gaming server is further adapted to determine if a respective group of game play requests meets the predefined condition by checking for a minimum number of game play requests in the respective group of game play requests periodically according to an incremental period of time.

14. The system of claim 11 wherein the gaming server is further adapted to determine if a respective group of game play requests meets the predefined condition by checking for a minimum number of game play requests in the respective group of game play requests in response to each game play request collected for the respective group of game play requests.

15. A program product stored on one or more tangible computer readable media, the program product including:

(a) first collection program code executable for collecting game play requests from a number of player stations into a first group of game play requests at a gaming server, wherein:

(i) each game play request in the first group is made in response to a respective input from a respective player at a respective one of the player stations;

(ii) each game play request in the first group constitutes a request to enter a bingo game, the bingo game being one of a number of bingo games played at the gaming server;

(iii) each game play request in the first group is sufficient to enter a respective wager from the respective player in the bingo game; and (iv) each game play request in the first group is entitled to receive a respective result for the bingo game, the result sufficient to 1) indicate no prize was awarded, 2) award the respective player a respective prize, or 3) award the respective player such a the respective prize contingent on receiving a player daub input for the respective game play request;

(b) first gaming server program code executable for, in memory at the gaming server, associating each game play request in the first group with a respective bingo card representation;

(c) first quorum checking program code executable for determining if the first group of game play requests meets a predefined condition for a first quorum required to conduct a first bingo game, the predefined condition including a minimum number of game play requests required to produce the first quorum, and wherein the first quorum checking program code is also executable to dynamically determine the minimum number of game play requests required to produce the first quorum, the dynamic determination being based upon system utilization conditions in a gaming system in which the player stations are included;

(d) game program code executable for, in response to meeting the predefined condition for the first quorum, conducting the first bingo game at the gaming server with the first group, the first bingo game being conducted by matching a plurality of bingo designations against the bingo card representations stored and determining the presence of one or more winning patterns;

(e) result program code executable for returning the respective result for the first bingo game responsive to each game play request in the first group, and awarding a credit award redeemable for money to each player whose game play request results in a winning pattern, and who daubs if a daub is required, as determined in the conduct of the first bingo game;

(f) wherein the first collection program code is further executable for collecting game play requests from the number of player stations into a second group of game play requests at the gaming server while conducting a portion of the first bingo game, wherein:

(i) each game play request in the second group is made in response to a respective input from a respective player at a respective one of the player stations;

(ii) each game play request in the second group constitutes a request to play in one of the bingo games played at the gaming server;

(iii) each game play request in the second group is sufficient to enter a respective wager from the respective player in the bingo game; and (iv) each game play request in the second group is entitled to receive a respective result for the bingo game, the result sufficient to 1) indicate no prize was awarded, 2) award the respective player a respective prize, or 3) award the respective player the respective prize contingent on receiving a player daub input for the respective game play request; and (g) wherein the first quorum checking program code is further executable for, while conducting a portion of the first bingo game, determining if the second group of game play requests meets a predefined condition for a second quorum.

16. The program product of claim 15 wherein the first quorum checking program code includes allocation program code executable for checking if a queue location has been allocated.

17. The program product of claim 15 wherein the first quorum checking program code includes timer program code executable for checking for the first quorum of game play requests in the first group of game play requests periodically at the end of an incremental period of time.

18. The program product of claim 15 wherein the first quorum checking program code includes receipt-check program code executable for checking for the first quorum of game play requests in the first group of game play requests in response to the collection of a respective one of the game play requests in the first group of game play requests.

19. The program product of claim 15 wherein the game program code is also executable for beginning to conduct the second bingo game with the second group of game play requests in response to meeting the predefined condition for the second quorum, at least a portion of the second bingo game being conducted concurrently with at least a portion of the first bingo game.

* * * * *

UNITED STATES PATENT AND TRADEMARK OFFICE

CERTIFICATE OF CORRECTION

PATENT NO. : 8,087,990 B2
APPLICATION NO. : 11/875697
DATED : January 3, 2012
INVENTOR(S) : Clifton E. Lind et al.

It is certified that error appears in the above-identified patent and that said Letters Patent is hereby corrected as shown below:

IN THE CLAIMS:

At column 29, claim 15, line 21: change “player such a the” to read --player the--.

Signed and Sealed this
Tenth Day of April, 2012

David J. Kappos
*Director of the United States Patent and Trademark Office*